US009141063B2

(12) United States Patent
Takehisa et al.

(10) Patent No.: US 9,141,063 B2
(45) Date of Patent: Sep. 22, 2015

(54) IMAGE FORMING APPARATUS AND METHOD

(71) Applicants: Akira Takehisa, Tokyo (JP); Yasushi Nakazato, Tokyo (JP); Osamu Satoh, Kanagawa (JP); Mikiko Imazeki, Kanagawa (JP)

(72) Inventors: Akira Takehisa, Tokyo (JP); Yasushi Nakazato, Tokyo (JP); Osamu Satoh, Kanagawa (JP); Mikiko Imazeki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/255,256

(22) Filed: Apr. 17, 2014

(65) Prior Publication Data

US 2014/0321865 A1 Oct. 30, 2014

(30) Foreign Application Priority Data

Apr. 26, 2013 (JP) ..... 2013-093896

(51) Int. Cl.
*G03G 15/00* (2006.01)
*G03G 21/00* (2006.01)

(52) U.S. Cl.
CPC ..... *G03G 15/55* (2013.01); *G03G 15/5037* (2013.01); *G03G 21/0094* (2013.01); *G03G 15/5033* (2013.01); *G03G 15/75* (2013.01); *G03G 2221/1663* (2013.01)

(58) Field of Classification Search
CPC ..... G03G 15/50
USPC ..... 399/26
See application file for complete search history.

(56) References Cited

U.S. PATENT DOCUMENTS

| | | | | |
|---|---|---|---|---|
| 7,433,611 | B2 * | 10/2008 | Nagamochi et al. | 399/26 |
| 8,116,640 | B2 * | 2/2012 | Zona et al. | 399/26 |
| 8,798,487 | B2 * | 8/2014 | Asano et al. | 399/26 |
| 2006/0104649 | A1 * | 5/2006 | Nagamochi et al. | 399/26 |
| 2010/0329701 | A1 * | 12/2010 | Zona et al. | 399/26 |
| 2011/0170884 | A1 * | 7/2011 | Yamane et al. | 399/26 |
| 2012/0183310 | A1 * | 7/2012 | Asano et al. | 399/26 |
| 2013/0011147 | A1 * | 1/2013 | Kimura et al. | 399/26 |
| 2013/0251383 | A1 * | 9/2013 | Imazeki et al. | 399/26 |
| 2013/0272723 | A1 * | 10/2013 | Imazeki et al. | 399/8 |
| 2014/0016951 | A1 * | 1/2014 | Takehisa et al. | 399/26 |
| 2014/0321865 | A1 * | 10/2014 | Takehisa et al. | 399/26 |

FOREIGN PATENT DOCUMENTS

| | | | | |
|---|---|---|---|---|
| JP | 2005-017512 | * | 1/2005 | G03G 21/00 |
| JP | 2006-301070 | | 11/2006 | |
| JP | 2010-072159 | * | 4/2010 | G03G 15/36 |

* cited by examiner

*Primary Examiner* — Clayton E Laballe
*Assistant Examiner* — Kevin Butler
(74) *Attorney, Agent, or Firm* — Oblon, McClelland, Maier & Neustadt, L.L.P.

(57) ABSTRACT

An image forming apparatus includes a deterioration determining device to determine a deterioration degree of a latent image bearer based on a potential detected by a surface potential detector. The deterioration determining device calculates a relative value indicating the deterioration degree based on the aggregated number of pixels and a time value for each of virtually divided regions. The deterioration determining device determines a deterioration degree of a detecting target region of the virtually divided region based on a potential detected by the surface potential detector. The deterioration determining device further determines deterioration degrees of non-detecting target respective regions of the virtually divided regions based on the relative values of the non-detecting target respective regions, the relative value of the detecting target region, and the deterioration degree of the detecting target region.

4 Claims, 17 Drawing Sheets

IMAGE FORMING APPARATUS AND METHOD

CROSS-REFERENCE TO RELATED APPLICATION

This patent application is based on and claims priority pursuant to 35 U.S.C. §119(a) to Japanese Patent Application No. 2013-093896, filed on Apr. 26, 2013 in the Japan Patent Office, the entire disclosure of which is hereby incorporated by reference herein.

BACKGROUND

1. Technical Field

This invention relates to an image forming apparatus having a determining device that determines a deterioration degree of a latent image bearer based on a result of detecting a surface potential of the latent image bearer.

2. Related Art

Conventionally, an image forming apparatus to form an image by using the below described electro-photography is known. Specifically, a surface of a latent image bearer is uniformly charged electrically by an electric charger such as a corona charger, etc. Subsequently, a latent image having a potential different from (e.g., opposite) the uniformly charge potential is written onto the latent image bearer by executing optical scanning. Subsequently, the latent image on the latent image bearer is developed by a developing unit as it selectively attaches toner thereto. While transferring the toner image obtained in this way onto a recording sheet by either directly or indirectly via an intermediate transferring member, the recording sheet with the toner image is output. Subsequently, residual electric charge is removed from the latent image bearer by an electric charge-removing device after the toner image is transferred therefrom. Subsequently, to prepare for the next latent image formation, the latent image bearer is uniformly charged again by the electric charger.

In such a system that conducts the electro-photography, as the latent image bearer repeats charging uniformly, writing the latent image, and removing the electric charge remaining on the latent image bearer, charging performance gradually deteriorates. Consequently, the latent image bearer markedly degrades the charging performance and becomes difficult to form a latent image with a stable potential thereby degrading image quality.

In a conventional image forming apparatus, immediately after a surface of a rotatable drum-type photoconductor as a latent image bearer is uniformly charged by an electric charger, a voltage sensor detects the uniformly charged potential. When the detection result is below a prescribed lower limit, the photoconductor is regarded as deteriorated and reaches the end of its working life, and is replaced with a new photoconductor.

By encouraging the user to replace the old photoconductor with the new photoconductor before the old photoconductor degrades to the point where it is difficult to form a latent image with a stable potential, image deterioration caused by such deterioration of the photoconductor can be minimized.

However, when a deterioration degree of the photoconductor is not uniform axially, the expiration of the photoconductor cannot be timely detected and may cause the deterioration of image quality.

Further, as a frequency of writing latent images on the photoconductor increases, the photoconductor is more quickly degraded. Accordingly, when the frequency of writing the latent image on the photoconductor deviates axially, the deterioration degree of photoconductor also deviates according to the deviation of the writing frequency. That is, in a region in which the latent images are relatively frequently written, deterioration progresses rapidly. By contrast, in another region in which the latent images are relatively rarely written, the deterioration does not progress rapidly.

Although the deterioration degree of the photoconductor deviates axially in this way, only a potential of a central region out of the whole region of the photoconductor axially is detected by a voltage sensor and whether or not the photoconductor as a whole has worn out is determined based only on its detection result in the conventional image forming apparatus. With such a system, however, when a side region more quickly deteriorates and wears out than a central region, such an effect cannot be detected and may end up causing deterioration of image quality.

SUMMARY

Accordingly, one aspect of the present invention provides a novel image forming apparatus that includes: a rotatable latent image bearer to bear a latent image on its surface; a charging device to electrically charge the surface of the latent image bearer; a latent image writing device to write the latent image on the electrically charge surface of the latent image bearer after a charging process of the charging device; a developing device to develop the latent image borne on the surface of the latent image bearer; a surface potential detector to detect a potential of the surface of the latent image bearer; a deterioration determining device to determine a deterioration degree of the latent image bearer based on a potential detected by the surface potential detector; a counter to count and aggregate the number of pixels output from a start of usage of the latent image bearer to each of virtually divided regions that is defined by virtually dividing the surface of the latent image bearer into multiple regions in a direction perpendicular to a rotating direction of the latent image bearer; and a time value determining device to determine a time value in accordance with a time at which a pixel is output to the virtually divided region. The deterioration determining device calculates a relative value based on the aggregated number of pixels and the time value for each of the virtually divided regions. The deterioration determining device determines the deterioration degree of a detecting target region of the virtually divided region based on the potential detected by the surface potential detector. The deterioration determining device further determines the deterioration degrees of non-detecting-target respective regions not detected by the surface potential detector based on the relative values of the non-detecting-target respective regions, the relative value of the detecting target region, and the deterioration degree of the detecting target regions.

Another aspect of the present invention provides a novel method of forming an image comprising the steps of: bearing a latent image on a surface of a rotatable latent image bearer; electrically charging the surface of the latent image bearer; writing the latent image on the electrically charge surface of the latent image bearer after charging thereof; and developing the latent image borne on the surface of the latent image bearer. The method further comprises the steps of: detecting a potential of the surface of the latent image bearer; determining a deterioration degree of the latent image bearer based on a detected potential; and counting and aggregating the number of pixels output after the latent image bearer is newly used to the virtually divided region that is defined by virtually dividing the surface of the latent image bearer into multiple regions in a direction perpendicular to a rotating direction of the latent image bearer. The method further comprises the steps of: determining a time value in accordance with a time at which a pixel is output to the virtually divided region; detecting the potential of a detecting target region; and calculating and obtaining a relative value based on the aggregated number of pixels and the time value for each of the virtually divided regions. The method further comprises the steps of: determining the deterioration degree of the detecting target region based on the potential detected by the surface potential detector; and determining the deterioration degrees of the non-detecting-target regions based on the relative values of the non-detecting-target regions, the relative value of the virtually divided region of the detecting target region, and the deterioration degree of thee detecting target region.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
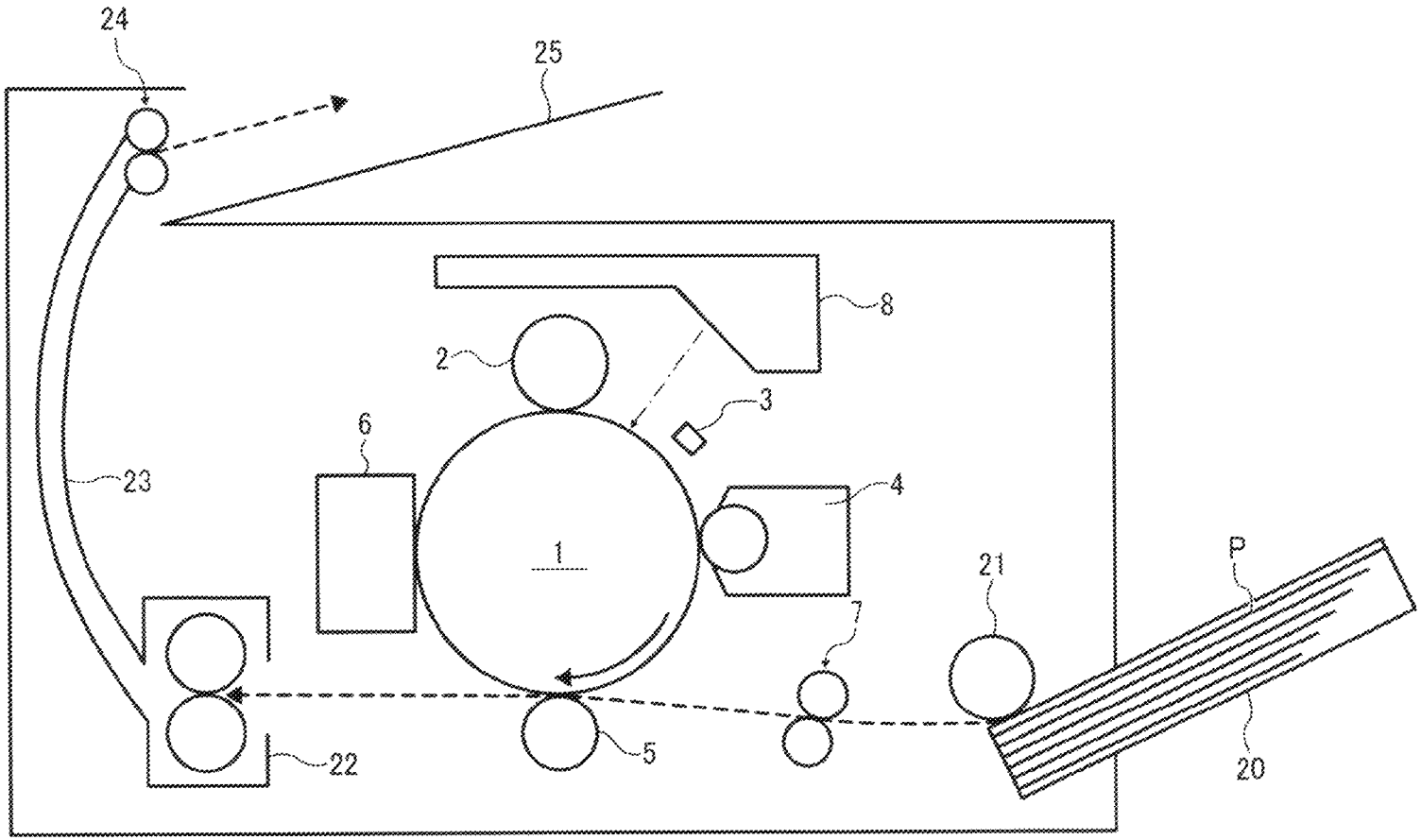
FIG. 1 is a schematic diagram illustrating a printer according to one embodiment of the present invention.

Referring now to the drawings, wherein like reference numerals designate identical or corresponding parts throughout the several views thereof and in particular to FIG. 1, a printer as an image forming apparatus to which one embodiment of the present invention is applied to form an image by using digital picture is described.

As shown there, a printer according to one embodiment of the present invention includes a drum-shaped photoconductor 1, an electric charger as a charging unit 2, a surface potential sensor 3, a developing unit 4, a transfer unit 5, an electric charge cleaner 6, a pair of registration rollers 7, and an optical writing unit 8 or the like. The printer also has a sheet feeding cassette 20, a sheet feeding roller 21, a fixing unit 22, a sheet exiting path 23, a pair of sheet exiting rollers 24, and a sheet exiting tray 25 or the like.

The drum-shaped photoconductor 1 has an organic photosensitive layer on a surface of a drum-shaped substrate and is driven by a driving device, not shown, in a clockwise direction in the drawing. Around the photoconductor 1, the charging unit 2, the surface potential sensor 3, the developing unit 4, the transfer unit 5, and an electric charge cleaner 6 are disposed.

The charging unit 2 uniformly charges a surface of the photoconductor 1 at an opposed position to the photoconductor 1 when the photoconductor 1 is driven and rotated. This printer employs a system, in which a charge bias is applied to a charging brush roller, which is driven and rotated while contacting the photoconductor 1, to uniformly charge the surface of the photoconductor 1. Instead of such a system, a scorotron corona charger, which is opposed to the surface of the photoconductor 1 across a gap, can be used. Another charging roller also can be disposed in contact with or close proximity to the surface the photoconductor 1 to discharge electricity in between itself and the photoconductor 1, thereby uniformly charging the surface thereof when a charging bias is applied thereto.

The surface of the photoconductor 1 uniformly charged by the charging unit 2 then receives optical scanning of writing light L emitted from the optical writing unit 8. In the entire region of the photoconductor 1, only a region subjected to the writing light L during the optical scanning reduces an electric potential thereby bearing an electrostatic latent image therein.

The surface potential sensor 3 as a surface potential detector detects a background potential Vd generated after the photoconductor 1 is uniformly charged and a latent image potential V1 (i.e., a potential of a latent image) as well. The surface potential sensor 3 then outputs a detection result with as a signal to a control unit, not shown, by using a well-known technology.

A surface of the photoconductor 1 passing through an opposing position to the surface potential sensor 3 then enters into an opposed position to the developing unit 4 in associated with rotational driving of the photoconductor 1. The developing unit 4 is composed of either a well-known one-component developing unit or a two-component developing apparatus. The developing unit 4 applies toner to the electrostatic latent image borne on the photoconductor 1 in the opposed region to the photoconductor 1 thereby rendering the electrostatic latent image visible (i.e., as a toner image). The toner image developed in this way then enters a transfer unit, in which the photoconductor 1 and the transfer unit 5 are opposed to each other, in associated with the rotation driving of the photoconductor 1.

On the other hand, into a body of the printer, the sheet feeding cassette 20 is installed. The sheet feeding cassette 20 houses multiple sheets of recording sheets (i.e., media) P piled up as a bundle therein. On the topmost recording sheet P of the bundle of the sheets housed in the sheet feeding cassette 20, a sheet feeding roller 21 is placed to contact the topmost recording sheet P. The sheet feeding roller 21 is driven and rotated at a predetermined time to launch the recording sheet P from the sheet feeding cassette 20 into a sheet feeding path.

Near the end of the sheet feeding path, a pair of registration rollers 7 rotating in contact with each other is disposed. The pair of registration rollers 7 temporarily stops its rotation when the recording sheet P is tucked into a registration nip formed therein. The pair of registration rollers 7 restarts the rotation driving at a time capable of overlaying the toner image on the recording sheet P in the transfer section (i.e., capable of synchronizing with the toner image), in which the photoconductor 1 and the transfer unit 5 are opposed to each other, to convey the recording sheet P toward the transfer section.

The transfer unit 5 forms an electric transfer field between the recording sheet P sent into the transfer section and the electrostatic latent image borne on the photoconductor 1 to move (i.e., transfer) the toner from the photoconductor 1 to the recording sheet P. Onto the surface of the recording sheet P sent into the transfer section, the toner image on the photoconductor 1 is transferred by the function of the electric transfer field. In this printer, the transfer unit 5 employs a system, in which the toner image on the photoconductor 1 is transferred onto the recording sheet P while applying a transfer bias to a transfer roller that engages with the photoconductor 1 while forming a transfer nip therebetween when it is tucked into the transfer nip. Instead of the above-described system of the transfer unit 5, a well-known corona charger system can be used as well. Otherwise, a system, in which a transfer bias is applied to a transfer member different from the above-described transfer roller can be used while bringing the transfer member in contact with the photoconductor 1.

The recording sheet P passing through the transfer section is sent to the fixing unit 22. The fixing unit 22 includes a fixing roller that contains a heat source such as halogen heater, etc., inside thereof and a pressing roller pressed against the fixing roller to form a fixing nip therebetween. Thus, the toner image borne on the surface of the recording sheet P sent into the fixing unit 22 is pressed and heated in the fixing nip and is fixed thereon.

On the other hand, a surface of the photoconductor 1 passing through the transfer section then enters an opposing position opposed to the electric charge cleaning device6. The electricity charge cleaner 6 includes an electric charge removing lamp and a cleaner, not shown. After post transfer residual toner that adheres onto the surface of the photoconductor 1 is scraped off from the surface of the photoconductor 1 by the cleaner, electric charge removing light is irradiated to the surface of the photoconductor 1 from the electric charge removing lamp to eliminate the electric charge remaining on the surface of the photoconductor 1 therefrom. Subsequently, the surface of the photoconductor 1 without the electric charge is uniformly charged again by the charging unit 2 to prepare for the next formation of a latent image.

The recording sheet P passing through the fixing unit 22 is ejected to an outside of the image forming apparatus (i.e., the printer) via a sheet exiting path 23 and a sheet exiting nip formed between the pair of sheet exiting rollers 24 as well, and is ultimately stacked on the sheet exiting tray 25 established outside the image forming apparatus.

Figure 2:
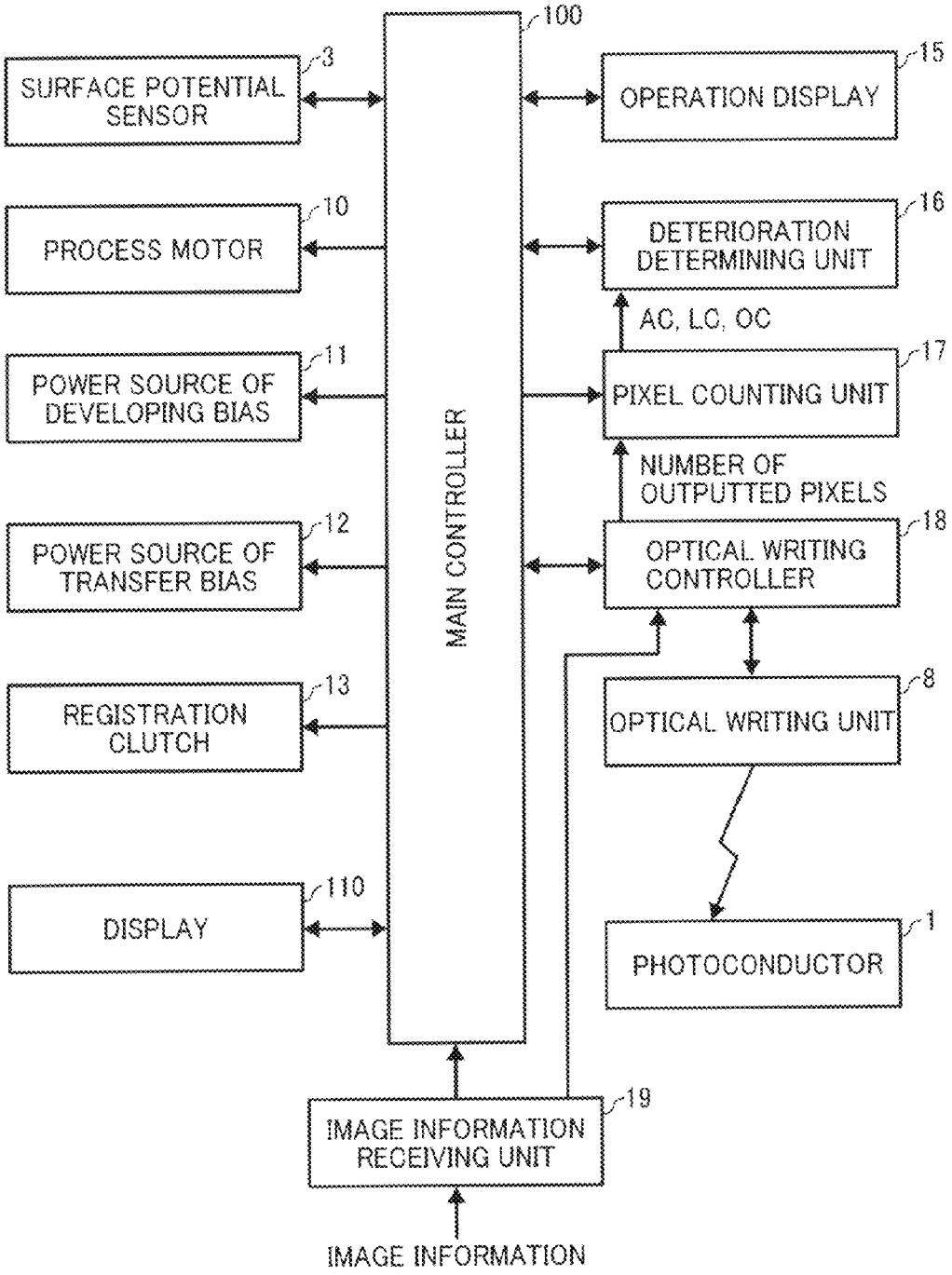
FIG. 2 is a block diagram illustrating an electric circuit included in the printer of FIG. 1 according to one embodiment of the present invention.

FIG. 2 is a block diagram partially illustrating an electric circuit included in the printer according to one embodiment of the present invention. In FIG. 2, a main controller 100 controls driving of various devices included in the printer. The main controller 100 includes a CPU (Central Processing Unit), a RAM (Random Access Memory) acting as a data storage device, and a ROM (Read Only Memory) acting as a data storage device or the like. Based on program stored in the ROM, the main controller 100 controls the driving of various devices and performs prescribed operations thereof.

To the main controller 100, the surface potential sensor 3, a processing motor 10, a developing bias power supply 11, a transfer-bias-power supply 12, and a registration clutch 13 are connected. In addition, to the main controller 100, an operation display 15, a deterioration determining unit 16, a pixel counting unit 17, an optical writing controller 18, and an image information receiving unit 19 or the like are connected.

The image information receiving unit 19 receives image information from a personal computer or a scanner and the like, not shown, operated by a user, and sends it to the optical writing controller 18 and the main controller 100 as well. The optical writing controller 18 provides optical scanning to a surface of the photoconductor 1 by controlling and driving the optical writing device 8 based on the image information coming from the image information receiving unit 19. As the optical writing unit 8 that provides the optical scanning to the photoconductor 1 by writing light Lin this way, a known laser system or a LED array and the like can be exemplified.

The processing motor 10 serves as a driving source of the photoconductor 1, the developing unit 4, and various rollers or the like. Rotational drive force of the processing motor 10 is transmitted to a pair of registration rollers 7 through the registration clutch 13. When the main controller 100 turns on the registration clutch 13 at a prescribed time, the rotational driving force of the processing motor 10 is conveyed to the pair of registration rollers 7.

The above-described developing unit 4 attaches toner borne on a surface of a developing roller, not shown, to the electrostatic latent image borne on the photoconductor 1 therefrom. To selectively attach the toner only to the electrostatic latent image among the entire surface of the photoconductor 1, a developing bias having the same polarity as the toner with its absolute value larger than that of a potential V1 of the latent image and smaller than a background voltage Vd of the photoconductor 1 is applied to the developing roller. For example, under a condition that a potential of the surface of the photoconductor is about −800 volt and that of the electrostatic latent image is about 50 volt, a developing bias of about −400 volt is applied to the developing roller. Here, a developing bias power supply 11 may output the developing bias. The main controller 100 sends an output command signal to the developing bias power supply 11 and renders the developing bias power supply 11 to output the developing bias at a prescribed time therefrom.

The main controller 100 also sends an output command signal to the transfer bias power supply 12 at any time and renders the transfer bias power supply 12 to output a transfer bias therefrom. The transfer bias is used to form the transfer field between the recording sheet P and the electrostatic latent image borne on the photoconductor 1 in the transfer section, in which the transfer unit 5 and the photoconductor 1 are opposed to each other.

The operation display 15 includes a ten-keypad and a touch panel as well, each not shown, and may display an image on the touch panel and sends various information entered through the touch panel and the ten-keypad as well to the main controller 100.

A result of detecting the surface potential of the photoconductor 1 by the surface potential sensor 3 is sent as a digital signal to the main controller 100, and is then sent to the deterioration determining unit 16. The deterioration determining unit 16 determines a deterioration degree of the photoconductor 1 based on the detection result of the surface potential (i.e., the digital signal). If it determines that the photoconductor 1 is completely degraded, the deterioration determining unit 16 sends a signal indicating the expiration of the photoconductor 1 to the main controller 100. When the main controller 100 receives the expiration signal from the deterioration determining unit 16, it displays messages on the operation display 15 such that "since it wears out, the photoconductor 1 should be replaced with new one". A function of the pixel counting unit 17 is described later in detail.

Figure 3:
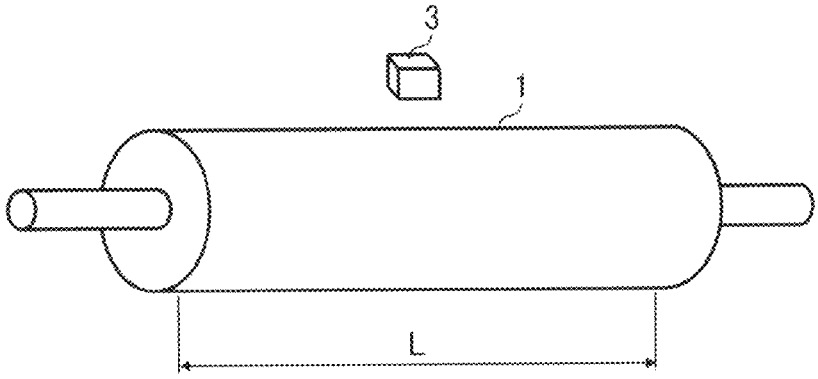
FIG. 3 is a perspective view illustrating a photoconductor and a surface potential sensor provided in the printer of FIG. 1 according to one embodiment of the present invention.

FIG. 3 is a perspective view illustrating the photoconductor 1 and the surface potential sensor 3 as well. The surface potential sensor 3 is disposed to detect a surface potential of only a central region out of the throughout region of the photoconductor 1 along its rotary axis as shown in the drawing. The deterioration degree of the central region out of the throughout region of the photoconductor 1 can be determined based on the detection result of the surface potential of the central region. However, a deterioration degree in a region other than the central region of the surface of the photoconductor 1 cannot be determined based only on the detection result of the surface potential in the central region.

Here, the printer according to one embodiment of the present invention can form an image on an A3-sized (JIS) recording sheet P (hereinafter referred to an A3-sized sheet sometimes) at most. Thus, a length of the photoconductor 1 axially is slightly greater than a dimension of a shorter side of the A3-sized sheet (i.e., the same as a dimension in a longitudinal direction of the A4 sized sheet of 297 mm). Hence, when forming an image on it, the A3-sized sheet is fed through the transfer section with its shorter side being parallel with the rotational axis of the photoconductor 1. By contrast, when forming an image on the A4-sized sheet, one of two conveying methods can be selected as an A4-sized sheet conveying method. Specifically, one of them is a horizontal conveying system, in which the A4-sized sheet is fed through the transfer section with its longer side being parallel with the rotational axis of the photoconductor 1. The other one of them is a vertical conveying system, in which the A4-sized sheet is fed through the transfer section with its shorter side being parallel with the rotational axis of the photoconductor 1.

Figure 4:
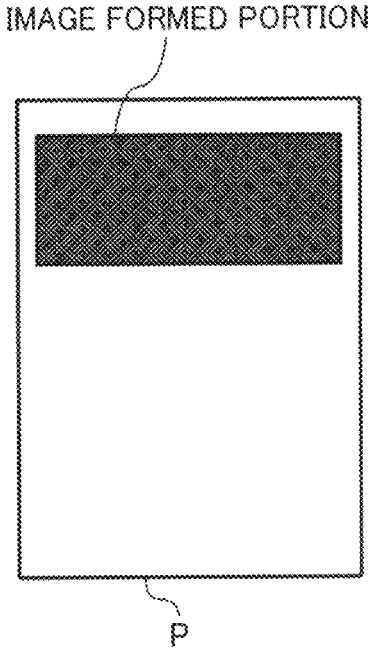
FIG. 4 is a schematic diagram illustrating an A4-sized (JIS) recording sheet and an image formed thereon according to one embodiment of the present invention.

FIG. 4 is a schematic diagram illustrating a recording sheet P having the A4 size and an image formed thereon. As shown, in a tip of the A4-sized sheet (i.e., a front region in the longitudinal direction thereof), a solid image is formed.

Figure 5:
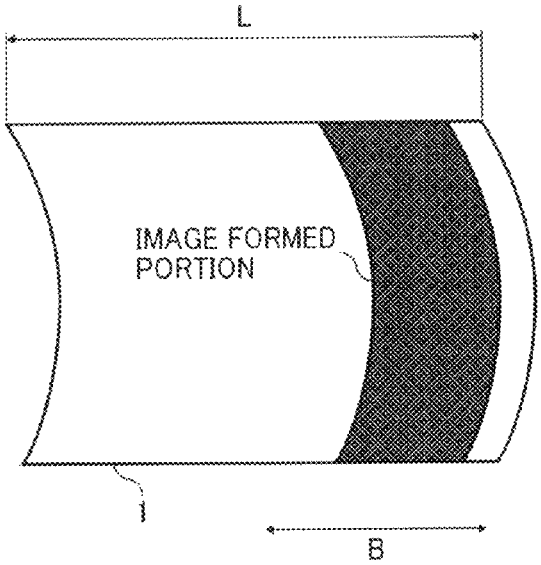
FIG. 5 is a schematic expansion plan illustrating a circumferential surface of the photoconductor provided in the printer of FIG. 1 according to one embodiment of the present invention.

FIG. 5 is a schematic diagram illustrating a circumferential surface of the photoconductor 1 by extending it on a plane. As shown there, a direction shown by arrow B indicates that of the rotational axis of the photoconductor 1. When the solid image shown in FIG. 4 is formed on the A4-sized sheet using the horizontal conveying system, the solid image is only formed on one end region out of the throughout region of the photoconductor 1 axially as shown in FIG. 5. For this reason, the optical writing process is only applied to the one end region.

Accordingly, in a user who highly frequently outputs the solid image of FIG. 4, the frequency of optical writing to one side region out the throughout region in the rotation direction of photoconductor 1 becomes relatively higher than that of optical writing to the other region thereof as shown in FIG. 5. Because of this, deterioration becomes quicker at one end region than at the other regions. However, as shown in FIG. 3, since the surface potential sensor 3 is disposed only in the central region of the photoconductor 1 along its rotary axis to detect the potential of the central region thereof, and the optical writing frequency is lower at the central region than that of the one end region, the central region sometimes does not yet reach the end of its useful life even though the one end region has been completely degraded.

In FIG. 3, an effective length L indicates an effective optical writing length of the photoconductor 1 along its rotary axis. The effective optical writing length represents a length of a region, onto which optical scanning is made (hereinafter referred to as an optical scanning target region), out of the entire region of the photoconductor 1 axially. Since a region distanced from both ends of the photoconductor drum 1 in its rotation direction by some degree defines the optical scanning target region, the effective length L becomes shorter than the total length of a drum-shaped section of the photoconductor 1.

In this printer, at a periodic time, such as when a prescribed number of sheets has been printed, process control is implemented. The process control is implemented to constantly output an image with prescribed density for a long period regardless of a change in environment or the like. Thus, upon need, an image forming condition, such as a background potential Vd of the photoconductor 1, a degree of optical writing intensity, a developing bias, etc., is corrected. Thus, in some cases, by adjusting the power supplied to the charging unit 2, the background potential Vd may be reduced from about −800 volt to about −750 volt, for example. Because of this, the deterioration degree of the photoconductor 1 cannot be precisely understood if only the background voltage Vd of the photoconductor 1 is detected by the surface potential sensor 3.

Therefore, in this printer, based not only on the background potential Vd of the photoconductor 1 but also a latent image potential V1 on the photoconductor 1 and a residual potential Vr remaining on the background after a electricity discharging process, a deterioration degree of the central region of the photoconductor 1 in its rotation direction is determined. This determination process may be executed at the beginning of a printing job as described below.

Specifically, in the determination process, first of all, the developing bias and the transfer bias are stopped outputting from the power sources while rotating and uniformly charging the photoconductor 1 with the electric charger as a charging unit 2. Subsequently, the background potential Vd is measured by the surface potential sensor 3 and it resulting date is stored in a memory as the background potential measurement value V1. Subsequently, a solid electrostatic latent image is written onto the background of the photoconductor 1 by the optical writing unit 8, and a potential of the solid electrostatic latent image is measured by the surface potential sensor 3 and it resultant data is stored in a memory as a latent image measurement value V2. Subsequently, a region entering an opposed position to the electric charge cleaning device 6 keeping a condition of the background out the throughout region of the photoconductor 1 is subjected to the electric charge removing process of the electric charge removing lamp, and is further moved to an opposed position to the surface potential sensor 3 without being subjected to uniformly done charging of the charging unit 2. Subsequently, the potential of the region is measured by the surface potential sensor 3, and is stored in a memory as a residual potential measurement value V3.

Since an attenuation rate of the potential due to the optical writing onto the photoconductor 1 decreases as the deterioration thereof progresses, the measurement potential value V2 of the latent image increases. For this reason, a calculation value (V2/V1) obtained by dividing the latent image potential measurement value V2 by the background potential measurement values V1 grows up. In addition, since the residual potential measurement value V3 increases as the deterioration of the photoconductor 1 progresses, an electricity discharging rate of the photoconductor 1 decreases in the background thereof by contrast. For this reason, a calculation value (V3/V1) obtained by dividing the residual potential measurement value V3 by the background potential measurement value V1 grows up.

Therefore, the deterioration degree of the photoconductor 1 can be determined based on the calculation values (V2/V1) and (V3/V1) obtained by the above-described calculations. However, the deterioration degree determined in this way only corresponds to (i.e., reflects) the central region out of the throughout region of the photoconductor 1 axially, a surface potential of which is detected by the surface potential sensor 3, as a problem.

Figure 6:
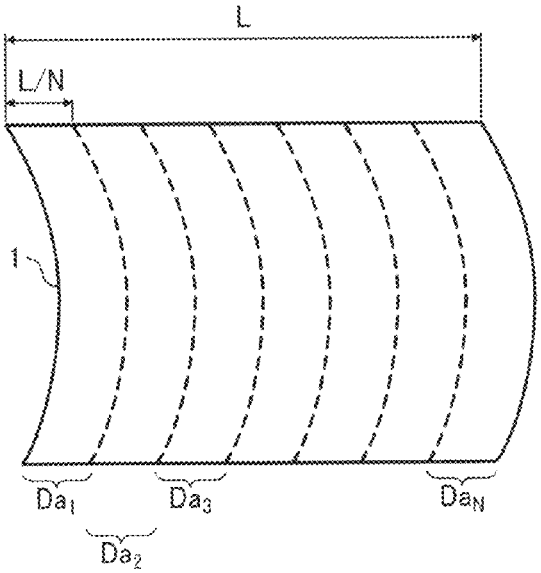
FIG. 6 is a schematic diagram illustrating virtually divided regions of a surface of the photoconductor according to one embodiment of the present invention.

Now, an exemplary configuration of the printer according to one embodiment of the present invention is described with reference to FIG. 6.

Conceivably, multiple sensors can be disposed side by side axially, and a deterioration degree of the end region also can be accurately detected as well beside the central region of the photoconductor axially. However, the use of multiple sensors is not cost-effective.

A region of the photoconductor may be virtually divided into multiple regions axially, and a deterioration degree of the central region in the center of the virtually divided regions axially determined based on a potential of the central region detected by a potential sensor. Specifically, the number of output pixels is calculated and aggregated as the number of cumulative pixels for each of the virtually divided regions when a latent image is formed, and a deterioration degree of each of the virtually divided regions other than the central region is estimated based on a deterioration degree of the central region.

That is, a ratio between each of the cumulative pixels of these virtually divided regions other than the central region and that of the central region is multiplied to the deterioration degree of the central region, and the deterioration degree of each of these virtually divided regions other than the central region is estimated. In such a system, deterioration degrees of the virtually divided regions can be estimated, respectively, with some degree of accuracy.

However, with such a system, when a frequency of writing latent images chronologically fluctuates, it becomes difficult to estimate the deterioration degree of each of these virtually divided regions accurately. Further, even when charging performance of the photoconductor deteriorates to some extent, the charging performance can revive by some degree if a frequency of writing the latent images is continuously low thereafter. That is, even when the aggregated number of pixels grows relatively higher in a virtually divided region, in which a frequency of writing the latent images is considerably low, the virtually divided region sometimes still demonstrates good charging performance.

Conversely, even when the aggregated numbers of pixels is relatively small in a virtually divided region, charging performance sometimes deteriorates sharply therein if a frequency of writing the latent images is considerably high recently.

By contrast, in a virtually divided region in which the aggregated number of pixels has become quite large, charging performance does not revive enough, even if a frequency of writing the latent images is low. Hence, it is difficult to estimate the deterioration degree in the virtually divided regions accurately.

To resolve such a problem, according to one embodiment of the present invention, an optical scanning target region of the photoconductor 1 of the printer is divided into N numbers of regions at even intervals along its rotary axis. A deterioration degree of each of such virtually divided regions obtained in this way is determined. The photoconductor 1 is disposed in the printer body with its rotational axis being parallel with a longitudinal direction of the printer body. Out of the N numbers of the virtually divided regions of the photoconductor 1, a first virtually divided region Da1 is located at a leading end (i.e., the most front side) of the photoconductor 1 axially (i.e., a direction shown by arrow B). Whereas, a virtually divided N-th region DaN is located at the end (i.e., the most backside) of the photoconductor 1 axially.

The optical writing controller 18 of FIG. 2 totals the numbers of pixels (i.e., the number of optical writing pixels) output per printing of one sheet onto the virtually divided first to N-th regions Da1 to DaN of the photoconductor 1, respectively, during a printing job based on the image information. Subsequently, each of the totaled results is output to the pixel counting unit 17 acting as a counter. The pixel counting unit 17 adds the numbers of output pixels sent from the optical writing controller 18 and updates the aggregated numbers of pixels AC and the latest aggregated numbers of pixels LC, respectively, of the virtually divided first to N-th regions Da1 to DaN. The aggregated numbers of pixels AC are obtained by aggregating output numbers of pixels from when the photoconductor 1 is newly used. Also, the latest aggregated numbers of pixels LC serve as aggregated numbers of output pixels to be reset to zero at every 1000 sheets of printing. The latest aggregated numbers of pixels LC right before resetting at every 1000 sheets of printing is stored in a memory as previously aggregated numbers of pixels OC aggregated previously (i.e., the last time).

A table 1 shown below indicates numeric variations occurring in the aggregated numbers of pixels AC, the latest aggregated numbers of pixels LC, and the previously aggregated numbers of pixels OC, respectively.

TABLE 1

| | NUMERIC VARIATION | | |
|---|---|---|---|
| | WHEN PHOTO-RECEPTOR IS REPLACED | AT EVERY ROTATION OF PHOTO-RECEPTOR | AT EVERY 1000 SHEETS OF PRINTING |
| AGGREGATED NUMBERS OF PIXELS: AC | RESET TO ZERO | ADDING NUMBER OF PIXELS | NOT CHANGED |
| LATEST AGGREGATED NUMBERS OF PIXELS: LC | RESET TO ZERO | ADDING NUMBER OF PIXELS | RESET TO ZERO |
| PREVIOUSLY AGGREGATED NUMBERS OF PIXELS: OC | RESET TO ZERO | NOT CHANGED | UPDATED TO SAME VALUE AS LC |

As shown in the table 1, when the photoconductor 1 is replaced with new one, all of the latest aggregated numbers of pixels AC, the latest aggregated numbers of pixels LC, and the previously aggregated numbers of pixels OC are reset to zeroes, respectively. Subsequently, the numbers of pixels output during the printing onto a single recording sheet (i.e., per printing onto one sheet) are added to the aggregated numbers of pixels AC and the latest aggregated numbers of pixels LC every when the printing onto one sheet is completed during the printing job. On the other hand, even when the printing onto one sheet is completed, the numbers of output pixels are not added to the previously aggregated respective numbers of pixels OC. A difference in numeric variation between the aggregated numbers of pixels AC and the latest aggregated number of pixels LC is that the latter are reset to zeroes, respectively, whereas the former are not reset thereto at every the number of 1000 sheets of printing. That is, the aggregated number of pixels AC are reset to zeroes, respectively, only when the photoconductor 1 is replaced. Further, the numbers of output pixels are not added to the previously aggregated numbers of pixels OC. Whereas, the previously aggregated numbers of pixels OC is updated to the same value as the latest aggregated numbers of pixels LC at that time at every 1000 sheets of printing.

Until the number of 999 sheets of printing is made after the photoconductor 1 is replaced, the aggregated numbers of pixels AC and the latest aggregated numbers of pixels LC are the same with each other while the previously aggregated numbers of pixels OC is zero. After that, when the number of 1000 sheets of printing has been made, the aggregated numbers of pixels AC maintains the value aggregated until then. By contrast, the latest aggregated numbers of pixels LC are reset to zeroes, respectively, at the time, respectively. At the same time, the previously aggregated numbers of pixels OC are updated to the same values with the latest aggregated numbers of pixels LC counted up until right before the resetting. In this way, the above-described processes are separately performed in the virtually divided first to N-th regions Da1 to Dan of the photoconductor 1, respectively. Herein below, the aggregated number of pixels AC, the latest aggregated number of pixels LC, and the previously aggregated number of pixels OC in the virtually divided X-th region Dax are after referred to as an aggregated number of pixels ACx, a latest aggregated number of pixels LCx, and a previously aggregated number of pixels OCx, respectively.

As described earlier, in this printer, the optical scanning target region of the photoconductor 1 is virtually divided into N items of regions along its rotary axis and deterioration degrees of the N number of virtually divided regions are detected, respectively. However, a surface potential of only one of the N number of virtually divided regions is detected by the surface potential sensor 3. Thus, the above described calculation results V2/V1 and V3/V1 (i.e., Latent image potential measurement value/Background potential measurement value and Residual potential measurement value/Background potential measurement value) only reflect deterioration degrees of the virtually divided central region out of the throughout region of the photoconductor 1 along its rotary axis. Hereinafter, the virtually divided region typically means the virtually divided central region (unless otherwise specified). Also, the calculation values V2/V1 and V3/V1 (i.e., Latent image potential measurement value/Background potential measurement value and Residual potential measurement value/Background potential measurement value) of the virtually divided central region are herein after referred to as reference deterioration degrees FC, respectively.

Herein below, one embodiment of the present invention is described, in which a region of a photoconductor 1 is divided into the number of 11 divisions of from first to 11-th virtually divided regions (i.e., Da1 to Da11) in its main scanning direction. However, even though it is not limited to eleven, the number of divisions is desirably odd to be able to define a virtually divided central region just at a center thereof in the main scanning direction.

Beside functioning as a counter to count the respective aggregated numbers of pixels (AC1 to AC11) of the virtually divided regions Da1 to Da11 of the photoconductor 1, the pixel counting unit 17 also functions as a time value determining device to determine a time value (e.g. 1, 0) that indicates a time at which a pixel is output. Specifically, the time value determining device determines and values a relatively recently output pixel out of the previously output pixels at "1" as the time value. By contrast, the time value determining device determines and values a pixel output relatively in an early stage out of the previously output pixels at "0" as the time value. Whether or not the pixel is relatively recently output is determined either every when the number of 1000 sheets has been printed and accordingly the latest aggregated number of pixels LC is reset or when the previously aggregated number of pixels OC is updated. Therefore, a pixel counted as the aggregated number of pixels OC or the latest aggregated number of pixels LC is regarded as the relatively recently output pixel, and is given the time value 1. Whereas, a pixel other than the pixel counted as the aggregated number of pixels OC or the latest aggregated number of pixels LC is regarded as the pixel output in the relatively early stage, and is given the time value 0. Accordingly, accumulation of the time value 1 given based on the pixel relatively recently output may reflect a recent situation of the frequency of writing the latent images.

Figure 7A:
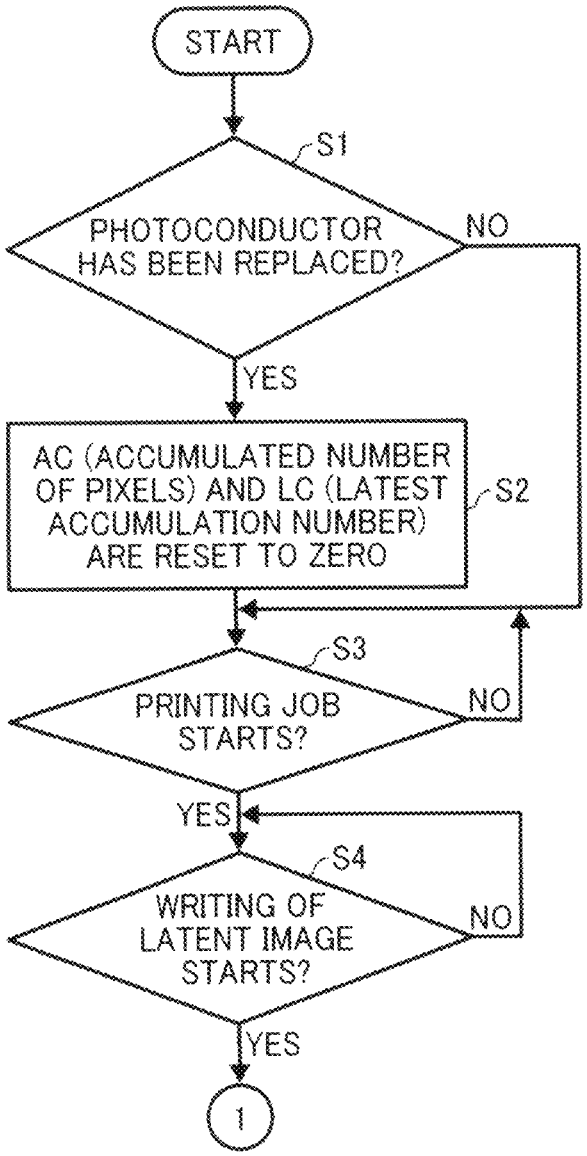
FIGS. 7A and 7B are flowcharts collectively illustrating a counting process carried out by a pixel counting unit provided in the printer according to one embodiment of the present invention.
Figure 7B:
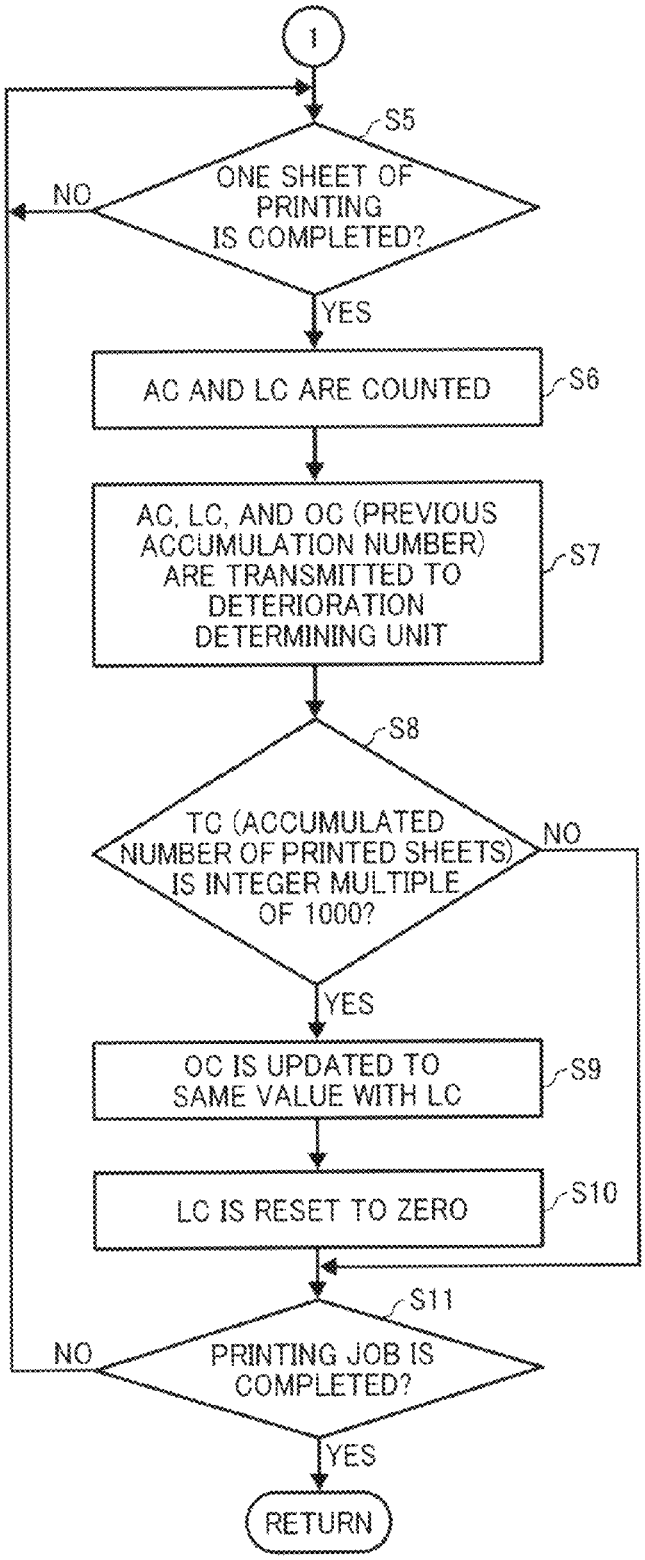

FIGS. 7A and 7B are flowcharts collectively illustrating a counting process carried out by the pixel counting unit 17 according to one embodiment of the present invention. As shown, initially, the pixel-counting unit 17 determines whether or not the photoconductor 1 is replaced (in step S1). This determination is made based on a detection result obtained by a known replacement detection device that detects replacement of the photoconductor 1. As a replacement detector, an information receiving device that receives information entered by a service person indicating that a photoconductor 1 has been replaced or the like is exemplified. Otherwise, another replacement detector can be used to detect replacement of the photoconductor 1 by reading and detecting a change in ID number included in an ID tag attached to a photoconductor unit that includes the photoconductor 1 though a communications line. When the pixel counting unit 17 has determined that the photoconductor 1 has been replaced (Yes, in step S1), the step goes to the next step S2. By contrast, when the pixel counting unit 17 has determined that the photoconductor 1 has not been replaced (No, in step S1), the step goes to the later described step S3.

In step S2, the aggregated numbers of pixels AC1 to AC11 and the latest aggregated numbers of pixels LC1 to LC11 are reset to zeroes, respectively. When the step S2 is completed, the step S3 is implemented. In step S3, a standby state continues until the printing job is started. When the printing job is started (Yes, in step S3), a standby state continues until a latent image writing process is started (in step S4). When the latent image writing process is initiated (Yes, in step S4,) and printing of one sheet is completed (Yes, in step S5), the aggregated numbers of pixels AC1 to AC11, and the latest aggregated numbers of pixels LC1 to LC11 are counted up, respectively, in step S6. Subsequently, these counting results are sent to the deterioration determining unit 16 together with the previously aggregated numbers of pixels OC1 to OC11 already stored at the time (in step S7).

Subsequently, the pixel counting unit 17 determines whether or not a cumulative counted number of sheets of printing TC is an integer multiple of 1000 (in step S8). Here, the cumulative counted number of sheets of printing TC is counted up by a aggregated number of sheets counting circuit, not shown, at every printing of a sheet, and is sent to the pixel counting unit 17 through the main controller 100. If the pixel counting unit 17 has determined that the cumulative counted number of sheets of printing TC is the integer multiple of 1000 (Yes, in step S8), it updates the previously aggregated numbers of pixels OC1 to OC11 to the same values with the previously aggregated numbers of pixels LC1 to LC11, respectively, in step S9. The pixel counting unit 17 then resets the latest aggregated numbers of pixels LC1 to LC11 to zeroes, respectively, (in step S10). Subsequently, the process is advanced to step S11 as described later. By contrast, if the cumulative counted number of sheets of printing TC is not the integer multiple of 1000 (No, in step S8) on the other hand, the process immediately proceeds to step S11.

In step S11, the pixel-counting unit 17 determines whether or not the printing job is completed. Subsequently, when the printing job is completed (Yes, in step S11), the process returns to step S1. By contrast, if the printing job is not completed (NO, in step S11), the process goes to step S6 flowing a loop and further keeps the standby state until one sheet of printing is completed.

Figure 8:
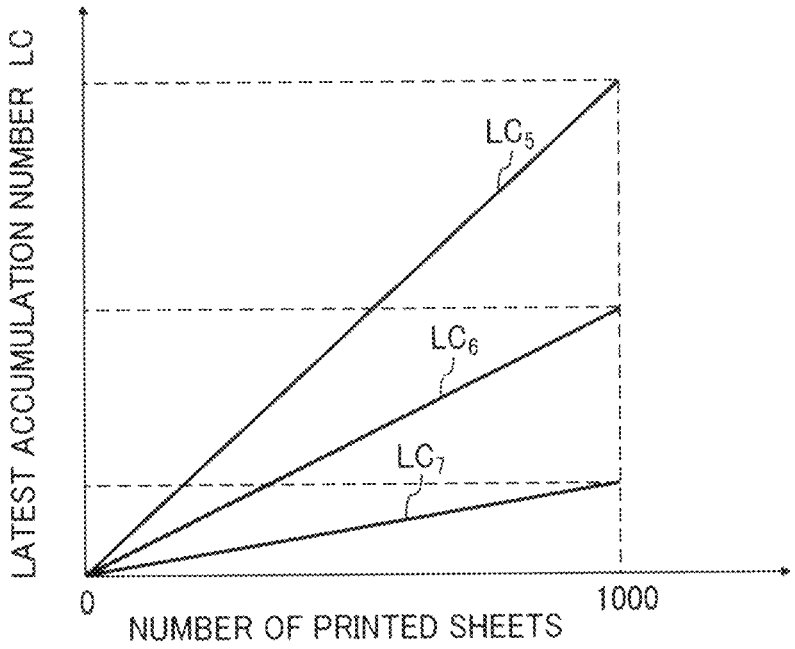
FIG. 8 is a graph illustrating one example of chronological changes in the latest aggregated numbers of pixels LC5 to LC7 in three virtually divided regions (Da5 to Da1) of the photoconductor, respectively, according to one embodiment of the present invention.

FIG. 8 is a graph illustrating an exemplary chronological change in the latest aggregated numbers of pixels LC5 to LC7 in the virtually divided three regions (Da5 to Da7). As illustrated in the graph, multiple slopes indicating the chronological changes of the latest aggregated numbers of pixels LC immediately after resetting those to zeroes until the number of 1000 sheets of printing has been made establish the following relation; LC5>LC6>LC7. In such a situation, the degrees of deterioration of these virtually divided three regions (Da5 to Da7) accordingly show the following relation in the term; Da5>Da6>Da7. However, the above-described relations are only phenomena caused in that limited time period, and when latent images are highly frequently written, for example, in the virtually divided seventh region Da7 after that, the above-described relation can be reversed. Therefore, the pixel counting unit 17 values the pixels output during the last 1000 sheets of printing and pixels output thereafter as well at "1" as the time values. Subsequently, these are aggregated and counted as the latest aggregated numbers of pixels LC and the previously aggregated numbers of pixels OC. By contrast, since the pixel output relatively older time (i.e., in the early stage) is valued at zero as the time value, those cumulative values are not counted. In this way, The pixel counting unit 17 calculates the aggregated numbers of pixels AC1 to AC11, the latest aggregated numbers of pixels LC1 to LC11, and the previously aggregated numbers of pixels OC1 to OC11 of the virtually divided first to 11-th regions Da1 to Da11 and sends these calculation results to the deterioration determining unit 16 every when one sheet of printing is made.

In this embodiment, among the virtually divided eleven regions Da1 to Da11, the virtually divided sixth region Da6 serves as the virtually divided central region and accordingly a detecting target region with its surface potential being detected by the surface potential sensor 3 as well. Accordingly, the other virtually divided regions (Da1 to Da5 and Da7 to Da11) serve as non-virtually divided regions with these surface potentials not being detected by the surface potential sensor 3.

As mentioned earlier, the reference deterioration degree Fc (i.e., the deterioration degree F6 in this example) of the virtually divided sixth region Da6 as the detecting target region can be accurately measured based on a detection result of the surface potential sensor 3. Accordingly, a deterioration determining unit 16 accurately calculates the reference deterioration degree Fc based on the surface potential detected by the surface potential sensor 3 in the above-described determining process. Subsequently, the deterioration determining unit 16 calculates deterioration degrees Fx (the suffix x indicates one of the virtually divided first to fifth and seventh to eleventh regions) of the respective virtually divided regions (Da1 to Da3 and Da7 to Da11) serving as the non-detection virtually divided regions per one sheet of printing during the printing job. Specifically, a first relative value ax and a second relative value βx are initially calculated based on the aggregated numbers of pixels AC1 to AC11, the latest aggregated numbers of pixels LC1 to LC11, and the previously aggregated numbers of pixels OC1 to OC11 coming from the pixel counting unit 17.

The first relative value ax relatively indicates a deterioration progressing degree in accordance with an increase in aggregated numbers of pixels ACx with reference to the virtually divided sixth region Da6 as the virtually divided central region, and is obtained by calculating the following formula: First relative value αx=ACx/AC6 (i.e., Aggregated number of pixels in the virtually divided x-th region/Aggregated number of pixels in the virtually divided sixth region).

Also, the second relative value βx relatively indicates a deterioration progressing degree obtained in accordance with a recent frequency of writing the latent images with reference to the virtually divided sixth region Da6, and is obtained by calculating the following formula: Second relative value βx=OCx+LCx)/OC6+LC6 (i.e., Previously aggregated numbers of pixels in the virtually divided x-th region+Latest aggregated numbers of pixels in the virtually divided x-th region/Previously aggregated numbers of pixels in the virtually divided sixth region+Latest aggregated number of pixels virtually divided sixth region).

The first relative value ax and the second relative value Px are relative values obtained with reference to the 6-th virtually divided region Da6. Accordingly, when the reference deterioration degree Fc (i.e., the deterioration degree F6 in this example) acting as the absolute deterioration degree of the virtually divided sixth region Da6 is multiplied by the product of those relative values, the deterioration degree Fx that accurately reflects the deterioration degree of the x-th virtually divided region Dax can be obtained. Therefore, the deterioration determining unit 16 calculates the deterioration degrees of the respective non-detection virtually divided regions (Da1 to Da5 and Da7 to Da11) by calculating the following expression: Deterioration degree Fx=Fc (i.e., F6 in this example)×αx×βx (i.e., Standard deterioration degree (i.e., F6 in this example)×First relative value in the x-th virtually divided region×Second relative value in the x-th virtually divided region).

Figure 9:
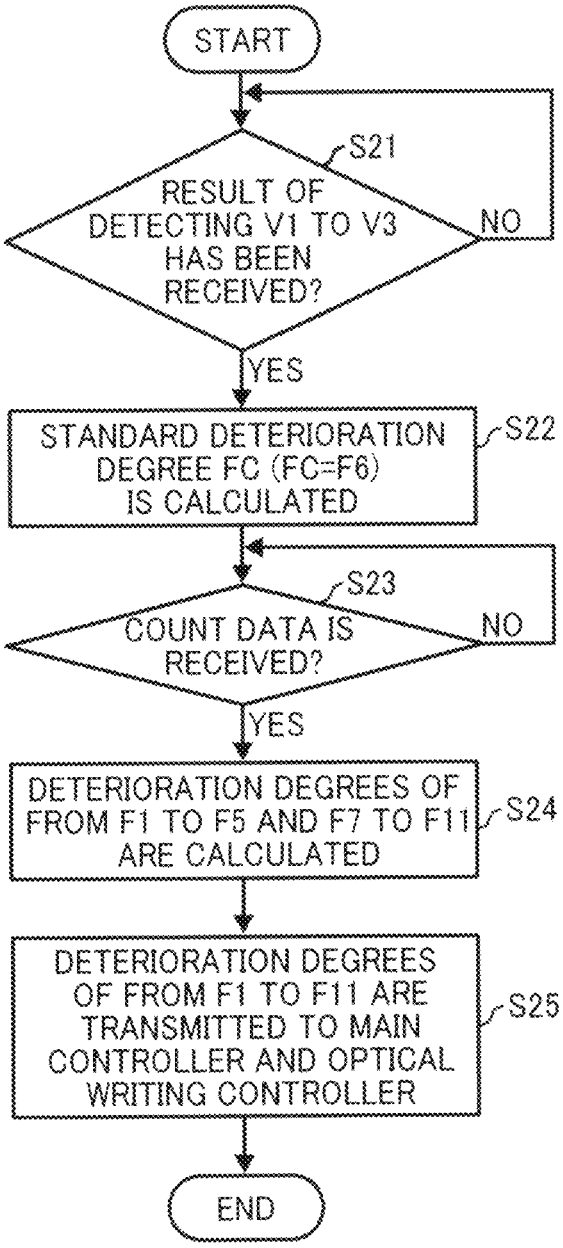
FIG. 9 is a flowchart illustrating a deterioration determination process carried out by a deterioration determining unit provided in the printer according to one embodiment of the present invention.

FIG. 9 is a flowchart indicating a deterioration detecting process conducted by the deterioration determining unit 16. As shown there, when the results of surface potential detection V1, V2, and V3 of the virtually divided central region (i.e., the virtually divided sixth region Da6) are sent from the main controller 100 (Yes, in step S21) and is received by it, the deterioration determining unit 16 calculates the reference deterioration degree Fc (i.e., F6) as a solution of the V2/V1 or V3/V1 based on those surface potential detection results V1, V2, and V3 (in step S22). When it receives counted data (i.e., AC1 to AC11, LC1 to LC11, and OC1 to OC11) from the pixel counting unit 17 (Yes, in step S23), the deterioration determining unit 16 calculates deterioration degrees F1 to F5 and F7 to F11 of the non-detection virtually divided regions (Da1 to Da5 and Da7 to Da11), respectively, based on the counted data and the reference deterioration degree Fc (in step S24). Subsequently, the deterioration determining unit 16 sends all of calculation results of the deterioration degrees F1 to F11 of the virtually divided respective regions Da1 to Da11 to the optical writing controller 18 through the main controller 100 (in step S25).

On the other hand, upon receiving all of the deterioration degrees Fx of the virtually divided regions Da1 to Da11 from the deterioration determining unit 16, the optical writing controller 18 (the main controller 100) sends them to the main controller 100. The main controller 100 then determines whether or not the photoconductor 1 wears out. That is, the main controller 100 specifies the maximum value in the deterioration degrees Fx of the virtually divided regions Da1 to Da11 and compares the maximum value with a prescribed threshold indicating expiration. Subsequently, the main controller 100 determines that the photoconductor 1 wears out when it determines that the specific maximum value exceeds the threshold. Subsequently, the main controller 100 renders the display unit 110 composed of a LCD display, etc., to display messages such that the photoconductor 1 has worn out or the like. With this, by timely knowing the effect that the photoconductor 1 has reached its expiration and replacing the photoconductor 1 with new one, a user can likely minimize generation of defective images due to the deterioration of the photoconductor 1.

Figure 10:
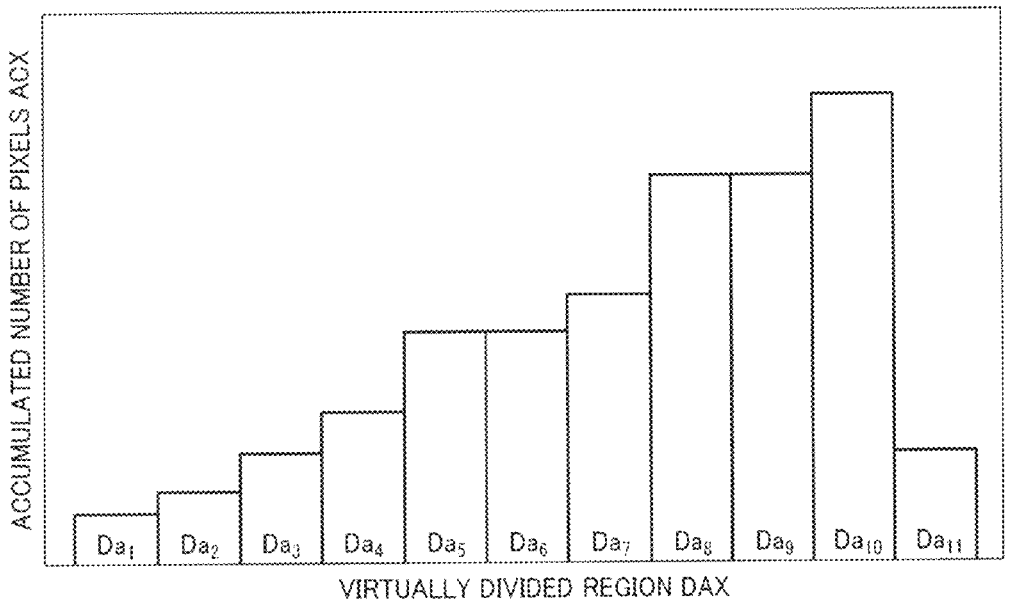
FIG. 10 is a bar graph illustrating an example of aggregated numbers of pixels AC1 to AC11 respectively in the virtually divided regions Da1 to Da11 at a time Tx according to one embodiment of the present invention.
Figure 11:
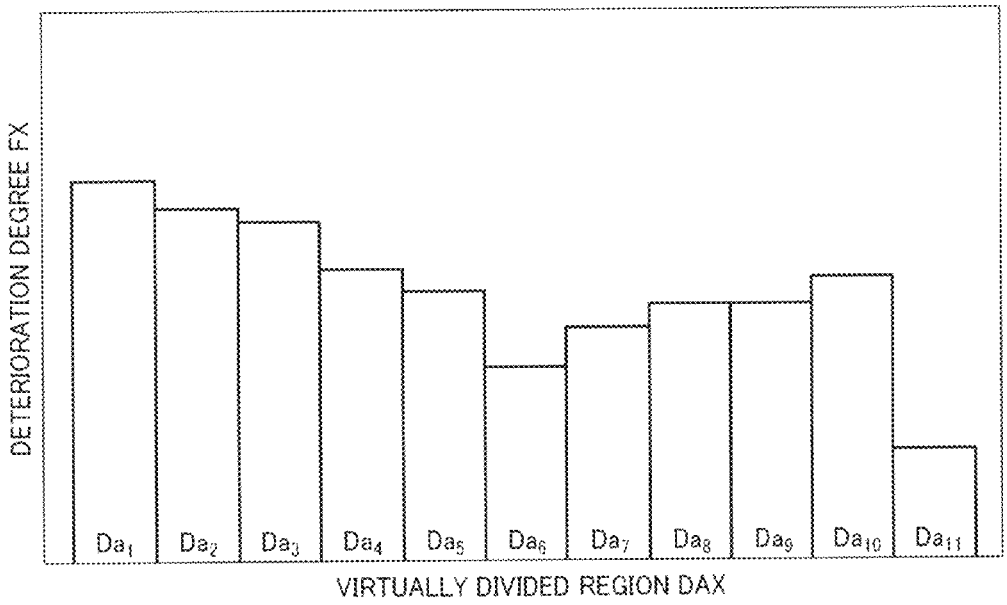
FIG. 11 is a bar graph illustrating an example of deterioration degrees F1 to F11 respectively in the virtually divided regions Da1 to Da11 at the time Tx according to one embodiment of the present invention.

FIG. 10 is a bar graph illustrating exemplary aggregated numbers of pixels AC1 to AC11 of the virtually divided respective regions Da1 to Da11 at a given time Tx. In this example, at the time Tx, the aggregated number of pixels AC10 of the virtually divided tenth region Da10 is the largest out of the throughout virtually divided regions Da1 to Da11, and is about eight times as many as the aggregated number of pixels AC1 of the virtually divided first region Da1. If the recent frequency of writing the latent images is neglected, it is likely determined that the deterioration degree of the virtually divided tenth region Da10 is the highest. However, when a frequency of writing the latent images in the virtually divided tenth region Da10 is significantly low relatively recently, a deterioration degree of a virtually divided region other than the virtually divided tenth region Da10 may be the highest. For example, if the recent frequencies of writing the latent images into the virtually divided respective regions from first to fifth (Da1 to Da5) are quite higher than those of the other virtually divided regions (Da6 to Da11), a magnitude correlation of the deterioration degrees in the respective virtually divided regions can be opposite to that of the aggregated numbers of pixels ACx shown in FIG. 10. Even in such a situation, as mentioned above, according to one embodiment of the present invention, since the printer calculates the deterioration degree by utilizing the second relative value β, it can accurately measure the deterioration degrees Fx of the virtually divided respective regions as shown in FIG. 11.

Figure 12:
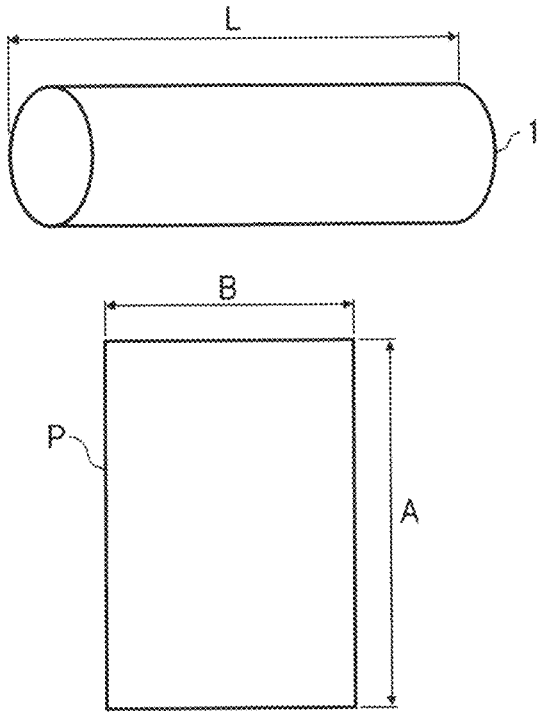
FIG. 12 is a schematic diagram illustrating a relation between an effective length L of the photoconductor, a conveying direction of a recording sheet P, and dimensions of the recording sheet P according to one embodiment of the present invention.
Figure 13:
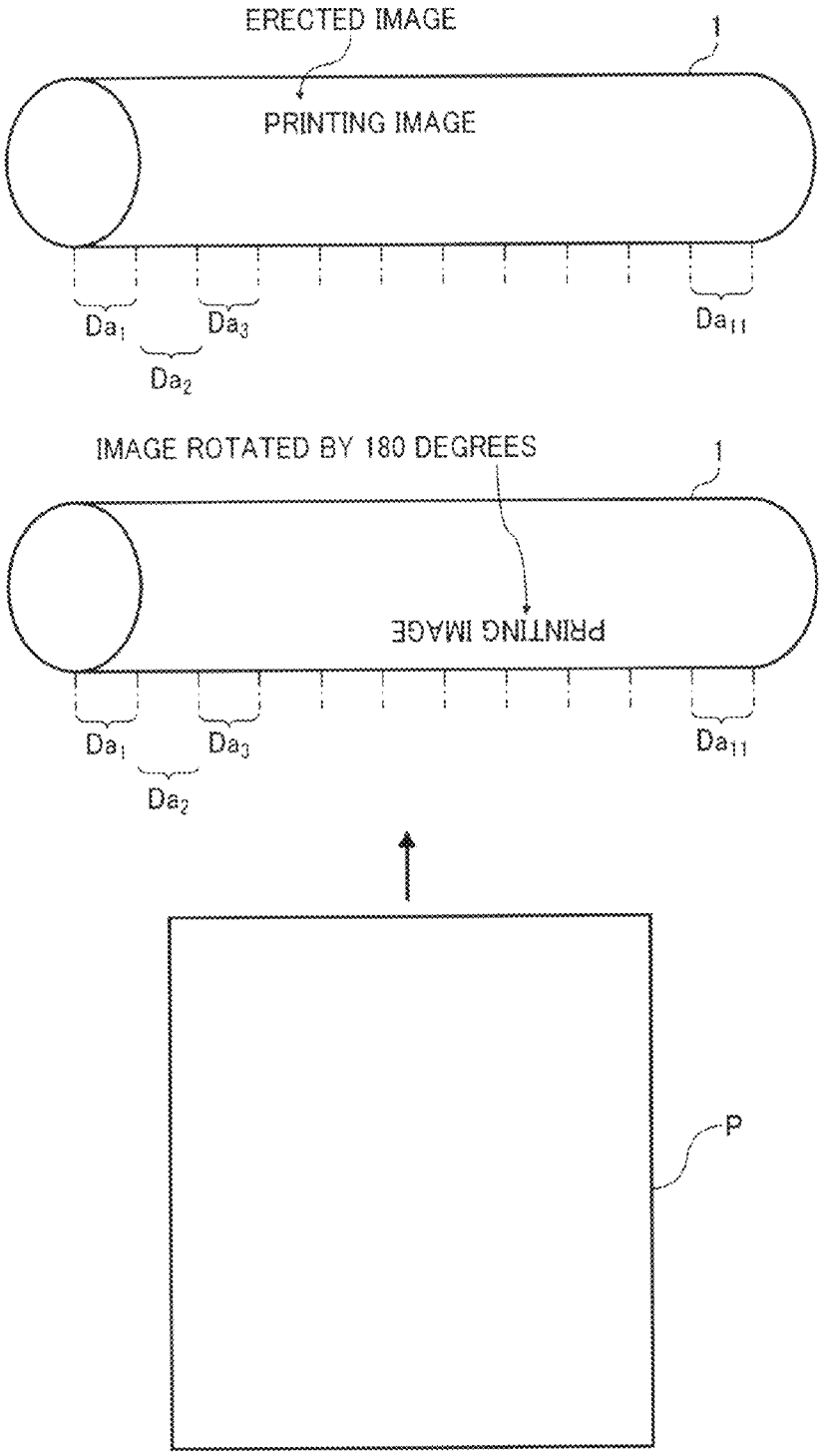
FIG. 13 is a schematic diagram illustrating a relation between a condition (i.e., an orientation) of an image, the number of pixels output into virtually divided regions, and a conveying direction of the recording sheet P according to one embodiment of the present invention.
Figure 14:
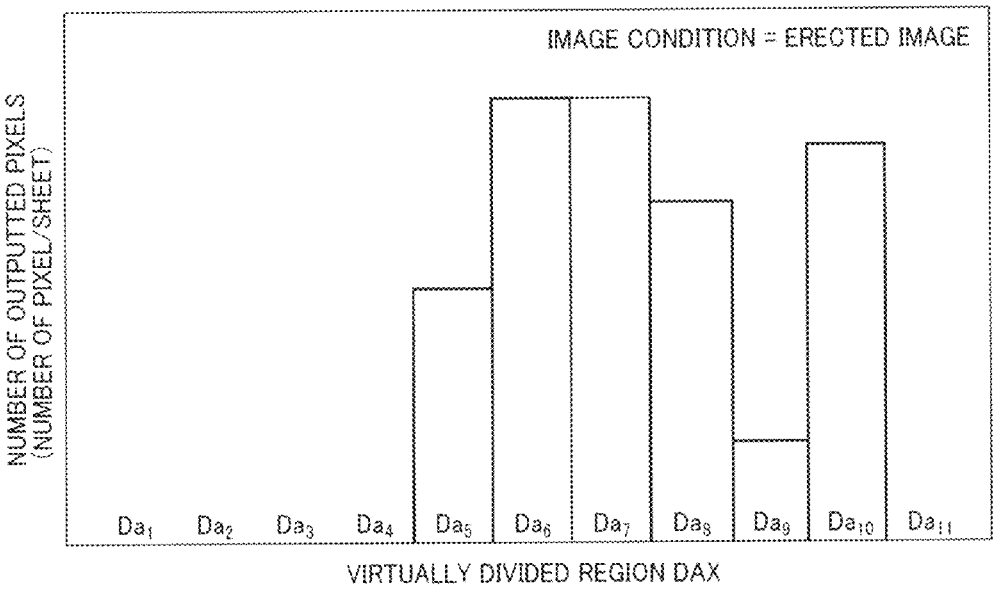
FIG. 14 is a bar graph illustrating an example of the numbers of pixels per page (or sheet) [number of pixel/page] output into the virtually divided regions when an image is formed in a normal orientation (i.e., an erected image) according to one embodiment of the present invention.
Figure 15:
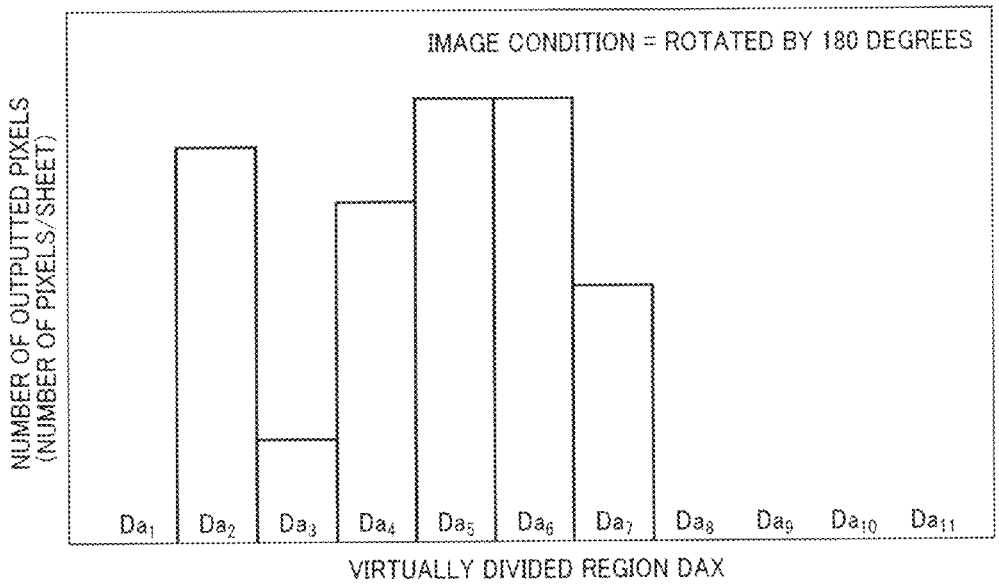
FIG. 15 is a bar graph illustrating an example of the numbers of pixels per page (or sheet) [number of pixel/page] output into the virtually divided regions when an image rotated by the angle of 180 degrees is formed according to one embodiment of the present invention.

FIG. 12 is a schematic diagram illustrating a relation between an effective length L of the photoconductor 1, a conveying direction of a recording sheet P, and dimensions of the recording sheet P. In the drawing, a legend B indicates a length of a shorter-side of the recording sheet P. A legend A indicates a longitudinal length of the recording sheet P. As shown there, as a conveying method of conveying the recording sheet P, a vertical conveying system, in which the recording sheet P is fed with its shorter side being parallel with the rotational axis of the photoconductor 1 and a horizontal conveying system, in which the recording sheet P is fed with its longer side being parallel with the rotational axis of the photoconductor 1. If the longitudinal length A of it is longer than the effective length L of the photoconductor 1, the recording sheet P only can be vertically conveyed using the vertically transportation system as illustrated in FIG. 12. Accordingly, as a system to rotate an orientation of an image on the photoconductor 1 without changing horizontal and vertical sides of the image on the recording sheet P, only a system to rotate the image on the photoconductor 1 by the angle of 180 degrees is exemplified as shown in FIG. 13. As understood from FIG. 13, a distribution of the numbers of output pixels in the virtually divided respective regions Da1 to Da11 is different between when the image is formed normally (i.e., erected) and when it is rotated by the angle of 180 degrees. FIG. 14 is a bar graph illustrating an example of the numbers of pixels output per page (i.e., per sheet) [pixel/page] in the virtually divided respective regions when an image is formed in a normal orientation according to one embodiment of the present invention. FIG. 15 is a bar graph illustrating an example of the numbers of pixels output per page (i.e., per sheet) [pixel/page] in the virtually divided respective regions when an image rotated by the angle of 180 degrees is formed according to one embodiment of the present invention. As shown there, the distribution of the number of output pixels significantly differs depending on the orientation of the image.

Accordingly, a printer according to one embodiment of the present invention is configured such that an image is formed in an orientation to mostly reduce the number of output pixels into a virtually divided region with the highest deterioration degree Fx out of the throughout virtually divided regions Da1 to Da11. However, when it is supposed here that the aggregated numbers of pixels ACx distributes as shown in FIG. 10 and accordingly the deterioration degree Fx distributes as shown in FIG. 11 both at a time Tx, a conventional system (e.g., a printer) that generally determines the deterioration degree just based on the aggregated numbers of pixels ACx has erroneously determined that the virtually divided tenth region D10 is mostly degraded. Accordingly, since the number of output pixels can be reduced in the virtually divided tenth region Da10 if it is rotated by the angle of 180 degrees as understood from FIGS. 14 and 15, the image is conventionally formed in such a rotated state. However, as understood from FIG. 11, the deterioration degree 1 is actually the highest in the virtually divided first region Da1 and not in the virtually divided tenth region Da10. Therefore, as understood from FIGS. 14 and 15, a regular orientation can reduce the number of output pixels. Despite that, since the image rotated by the angle of 180 degrees is conventionally formed, the deterioration degree in the virtually divided first region Da1 is rather progressed thereby shortening the working life of the photoconductor 1 in the past.

Figure 16:
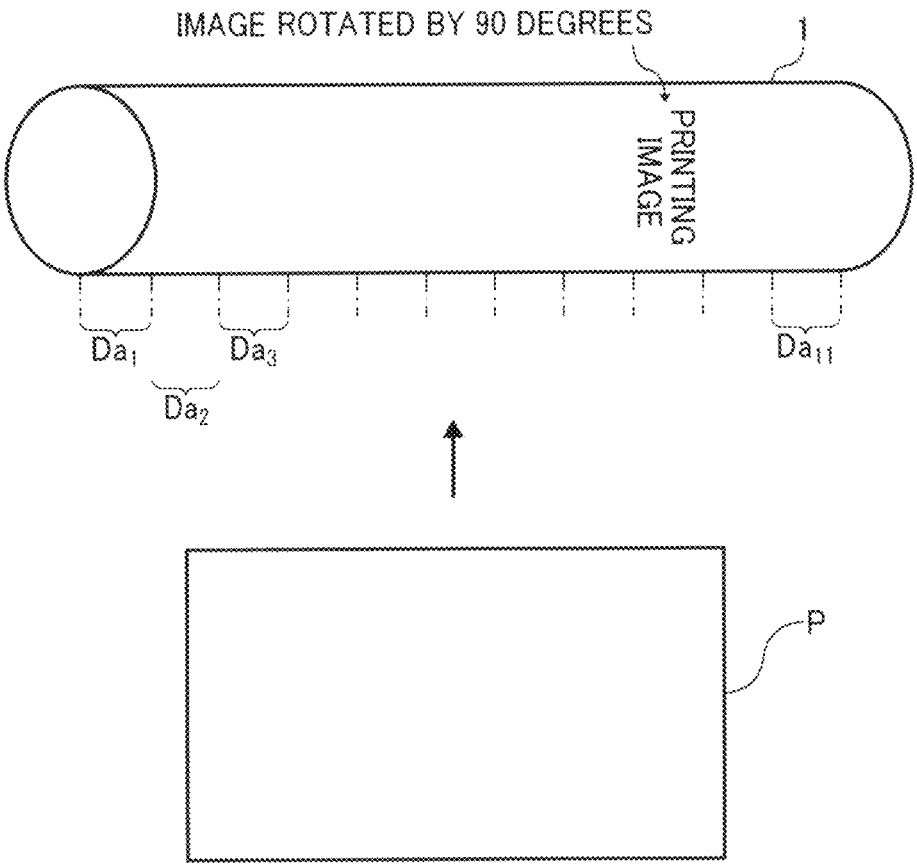
FIG. 16 is a schematic diagram illustrating the numbers of pixels output into respective virtually divided regions when an image rotated by the angle of 90 degrees is formed while a conveying system for conveying the recording sheet is changed from a vertical conveying system to a horizontal transportation system according to one embodiment of the present invention.
Figure 17:
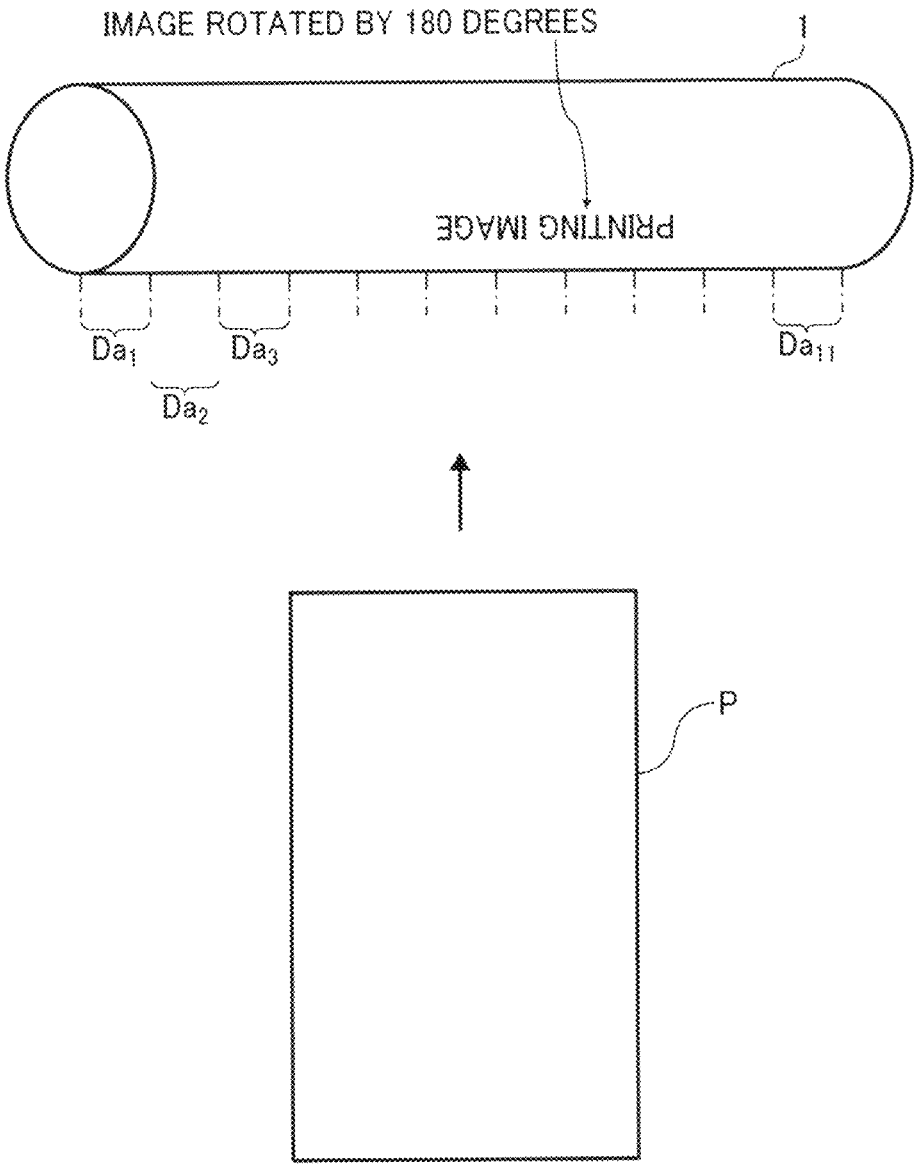
FIG. 17 is a schematic diagram illustrating the numbers of pixels output into respective virtually divided regions when an image rotated by the angle of 180 degrees is formed while the vertical conveying system is maintained as the conveying system for conveying the recording sheet Pertaining to an embodiment.
Figure 18:
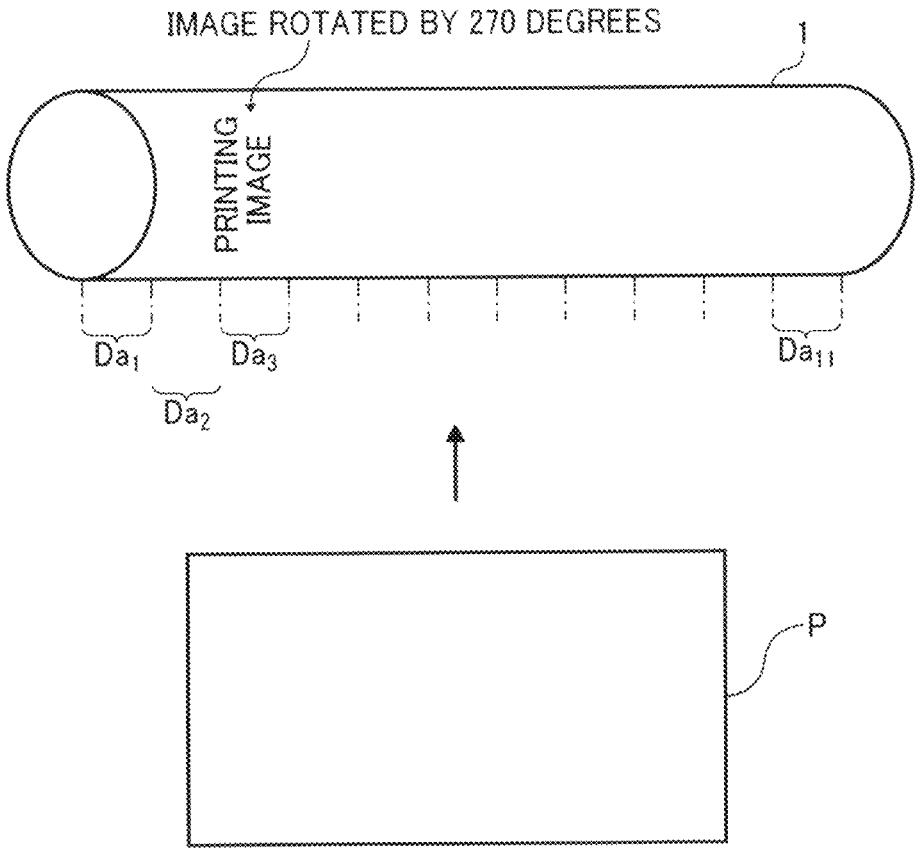
FIG. 18 is a schematic diagram illustrating the numbers of pixels output into respective virtually divided regions when an image rotated by the angle of 270 degrees is formed while the vertical conveying system is changed to the horizontal transportation system according to one embodiment of the present invention.

By contrast, in a printer according to one embodiment of the present invention, since the deterioration degree Fx is accurately calculated using the second relative value βx, and accordingly the normal orientation of the image is correctly selected, the working life of the photoconductor 1 can be likely prolonged. If the longitudinal length A of the recording sheet P is shorter than the effective length L of the photoconductor 1, the horizontal conveying system can be also adopted beside the vertical conveying system. Accordingly, as a system to rotate the orientation of the image on the photoconductor 1 without changing horizontal and vertical sides of the image on the recording sheet P, three systems can be exemplified as shown in FIGS. 16 to 18. That is, the image can be rotated by 90, 180, and 270 degrees, respectively, on the photoconductor 1. Accordingly, when including the normal orientation, the four orientations can be selected. Therefore, in the printer according to one embodiment of the present invention, the image is formed by choosing an orientation of an image among the four orientations capable of reducing the number of output pixels in the virtually divided region with the highest deterioration degree Fx.

Figure 19A:
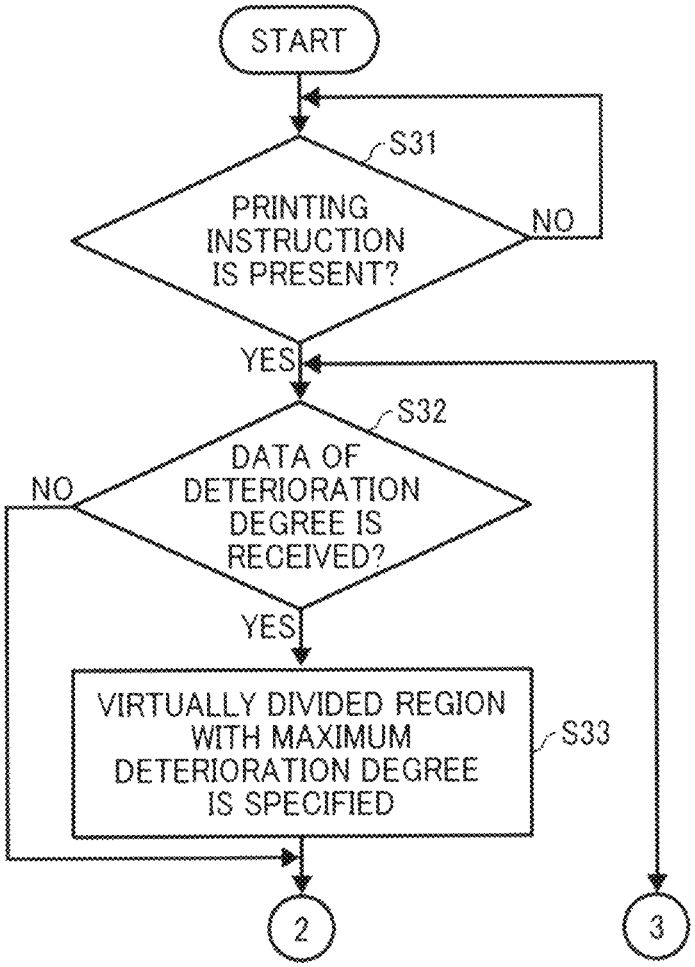
FIGS. 19A and 19B are flowcharts collectively illustrating an image condition (i.e. an orientation) determining process carried out by an optical writing controller according to one embodiment of the present invention.
Figure 19B:
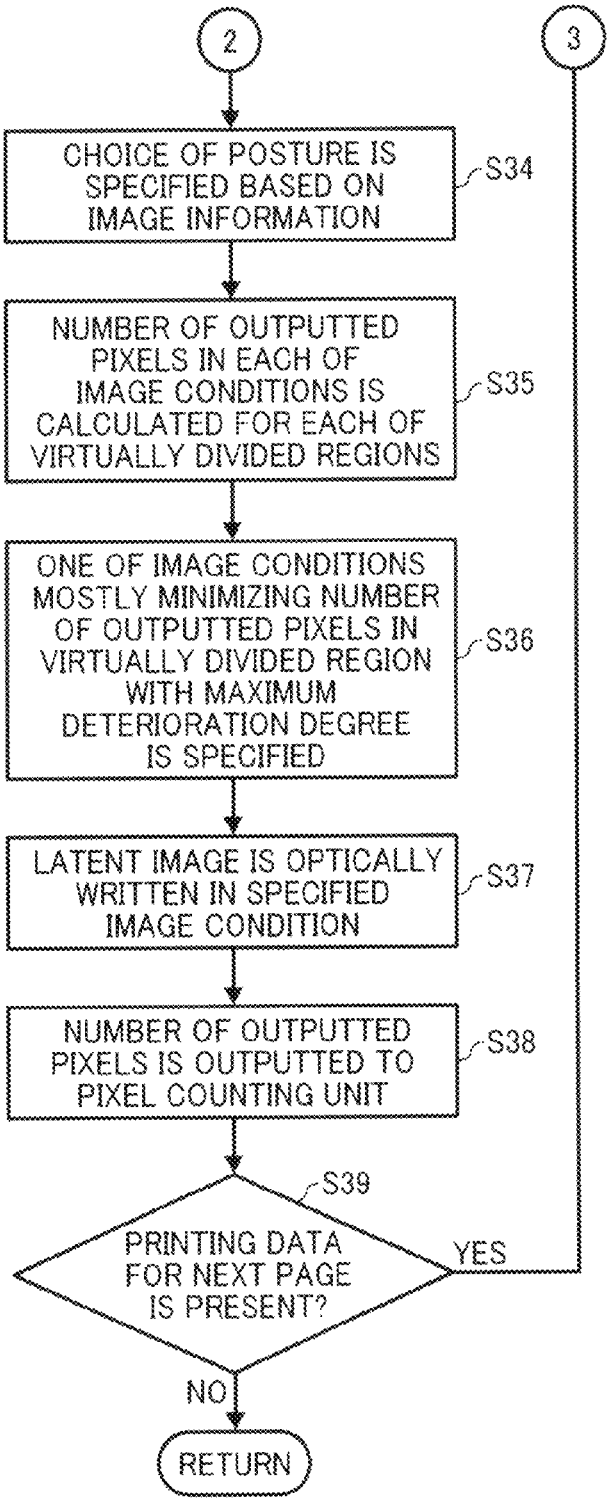

FIGS. 19A and 19B are flowcharts collectively illustrating an image condition (i.e., orientation) determining process carried out by the optical writing controller 18 according to one embodiment of the present invention. Specifically, as shown there, upon receiving a printing instruction from a user (Yes, in step S31), the optical writing controller 18 determines whether or not it has received the deterioration degrees F1 to F11 output from the deterioration determining unit 16 (in step S32). When it determines that the deterioration degrees F1 to F11 have been received, the optical writing controller 18 identifies a virtually divided region with the highest deterioration degree Fx as a virtually divided region with the maximum deterioration degree in step S3 among the throughout virtually divided regions Da1 to Da11. After that, the process goes to step S34 as described later. By contrast, when the deterioration degrees F1 to F11 have not been received by the optical writing controller 18, the sequence proceeds directly to step S34. In step S34, based on image information, the number of choices capable of changing the orientation of the image is identified. Specifically, it is determined if the number of choices is two of the normal orientation and the rotated state by the angle of 180 degrees, or four of the normal orientation, the rotated state by the angle of 90 degrees, that by the angle of 180 degrees, and that by the angle of 270 degrees. Subsequently, the numbers of output pixels in the virtually divided respective regions Da1 to Da11 are calculated for all of selectable image orientations per page (in step S35). Subsequently, the image orientation capable of minimizing the number of pixels output into the virtually divided region with the highest deterioration degree (S36) is identified. Subsequently, a latent image is optically written onto the photoconductor in the identified orientation in step (S37). The numbers of pixels output by the optical writing into the virtually divided respective regions Da1 to Da11 are output to the pixel counting unit 17. As mentioned earlier, based on the numbers of output pixels received in this way, the pixel counting unit 17 counts up the aggregated numbers of pixels AC1 to AC11 and the latest aggregated numbers of pixels LC1 to LC11, respectively. The optical writing controller 18 having output the number of pixels determines if printing data exists in the next page, and if it practically exists (Yes, in step S39), the process goes to step S32 flowing a loop. Hence, an orientation of an image of the next page is similarly determined, and a latent image is similarly optically written on the next page and the like. On the other hand, if no print data exists in the next page, a series of processes are completed and the process returns to step S31.

According to one aspect of the present invention, a deterioration degree of a virtually divided region of a latent image bearer as a detecting target region and deterioration degrees of the other virtually divided respective regions thereof other than the detecting target region can be accurately determined regardless of a chronological change in frequency of writing latent images thereonto. That is, an image forming apparatus comprises a rotatable latent image bearer to bear a latent image on its surface; a charging device to electrically charge the surface of the latent image bearer; a latent image writing device to write the latent image on the electrically charge surface of the latent image bearer after a charging process of the charging device; a developing device to develop the latent image borne on the surface of the latent image bearer; a surface potential detector to detect a potential of the surface of the latent image bearer; a deterioration determining device to determine a deterioration degree of the latent image bearer based on a potential detected by the surface potential detector; a counter to count and aggregate the number of pixels output after the latent image bearer is newly used to each of virtually divided regions that is defined by virtually dividing the surface of the latent image bearer into multiple regions in a direction perpendicular to a rotating direction of the latent image bearer; and a time value determining device to determine a time value in accordance with a time at which a pixel is output to the virtually divided region. The surface potential detector detects the potential of a detecting target region of the virtually divided region and calculates and obtains a relative value based on the aggregated number of pixels and the time value for each of the virtually divided regions. The deterioration determining device determines the deterioration degree of the virtually divided region of the detecting target region based on the potential detected by the surface potential detector. The deterioration determining device further determines the deterioration degrees of non-detecting-target respective regions of the virtually divided regions other than the detecting target region based on the relative values of the non-detecting-target respective regions, the relative value of the detecting target region, and the deterioration degree of the detecting target region.

According to another aspect of the present invention, the deterioration degree of the virtually divided region of the latent image bearer as the detecting target region and deterioration degrees of the other virtually divided regions thereof other than the detecting target region can be more accurately determined regardless of a chronological change in frequency of writing latent images thereonto. That is, an equalizing orientation determining device determines whether or not the deterioration degrees of the virtually divided respective regions can be substantially equalized by changing an orientation of the next image after counting the numbers of pixels of the next image output to the virtually divided respective regions when the next image is formed on the surface of the latent image bearer in a normal orientation based on image information. The latent image writing device writes a latent image onto the image bearer with its orientation being changed when the equalizing orientation determining device has determined that the deterioration degrees in the virtually divided respective regions can be substantially equalized by changing the orientation of the next image. The counter counts the numbers of pixels of the orientation changed next image output to the virtually divided respective regions when the orientation of the latent image is changed.

According to yet another aspect of the present invention, a deterioration degree of a virtually divided region of a latent image bearer as a detecting target region and deterioration degrees of the other virtually divided regions thereof other than the detecting target region can be more accurately determined regardless of a chronological change in frequency of writing latent images thereonto. That is, an alarm is further provided in the image forming apparatus to transmit a message that expiration of the latent image bearer is reached when the deterioration degree of any one of the virtually divided regions reaches or exceeds a prescribed threshold.

Numerous additional modifications and variations of the present invention are possible in light of the above teachings. It is therefore to be understood that within the scope of the appended claims, the present invention may be executed otherwise than as specifically described herein. For example, the order of steps for forming in the image forming apparatus is not limited to the above-described various embodiments and may be altered as appropriate.

What is claimed is:

1. An image forming apparatus comprising:

a rotatable latent image bearer to bear a latent image on its surface;

a charging device to electrically charge the surface of the latent image bearer;

a latent image writing device to write the latent image on the electrically charge surface of the latent image bearer after a charging process of the charging device;

a developing device to develop the latent image borne on the surface of the latent image bearer;

a surface potential detector to detect a potential of the surface of the latent image bearer;

a deterioration determining device to determine a deterioration degree of the latent image bearer based on a potential detected by the surface potential detector;

a counter to count and aggregate the number of pixels output after the latent image bearer is newly used to each of virtually divided regions of the latent image bearer, the virtually divided regions of the latent image bearer defined by virtually dividing the surface of the latent image bearer into multiple regions in a direction perpendicular to a rotating direction of the latent image bearer;

a time value determining device to determine a time value in accordance with a time at which a pixel is output to the virtually divided region, in which the pixel is determined to be outputted recently or outputted relative to a predetermined number of sheets that have been printed; and an alarm to transmit a message that expiration of the latent image bearer is reached when the deterioration degree of any one of the virtually divided regions reaches or exceeds a prescribed threshold, wherein the surface potential detector detects a potential of a detecting target region of the virtually divided region, wherein the deterioration determining device calculates a relative value based on the aggregated number of pixels and the time value per virtually divided region, the deterioration determining device determining a deterioration degree of the detecting target region of the virtually divided region based on the potential detected by the surface potential detector, and the deterioration determining device further determining the deterioration degrees of non-detecting target respective regions of the virtually divided regions other than the detecting target region based on the relative values of the non-detecting-target respective regions, the relative value of the detecting target region, and the deterioration degree of the detecting target region.

2. An image forming apparatus comprising:

a rotatable latent image bearer to bear a latent image on its surface;

a charging device to electrically charge the surface of the latent image bearer;

a latent image writing device to write the latent image on the electrically charge surface of the latent image bearer after a charging process of the charging device;

a developing device to develop the latent image borne on the surface of the latent image bearer;

a surface potential detector to detect a potential of the surface of the latent image bearer;

a deterioration determining device to determine a deterioration degree of the latent image bearer based on a potential detected by the surface potential detector;

a counter to count and aggregate the number of pixels output after the latent image bearer is newly used to each of virtually divided regions of the latent image bearer, the virtually divided regions of the latent image bearer defined by virtually dividing the surface of the latent image bearer into multiple regions in a direction perpendicular to a rotating direction of the latent image bearer; and a time value determining device to determine a time value in accordance with a time at which a pixel is output to the virtually divided region, in which the pixel is determined to be outputted recently or outputted relative to a predetermined number of sheets that have been printed;

an equalizing orientation determining device to determine whether or not the deterioration degrees of the virtually divided respective regions can be substantially equalized by changing an orientation of the next image after counting the numbers of pixels of the next image output to the virtually divided respective regions when the next image is formed on the surface of the latent image bearer in a normal orientation based on image information; and an alarm to transmit a message that expiration of the latent image bearer is reached when the deterioration degree of any one of the virtually divided regions reaches or exceeds a prescribed threshold, wherein the surface potential detector detects a potential of a detecting target region of the virtually divided region, wherein the deterioration determining device calculates a relative value based on the aggregated number of pixels and the time value per virtually divided region, the deterioration determining device determining a deterioration degree of the detecting target region of the virtually divided region based on the potential detected by the surface potential detector, the deterioration determining device further determining the deterioration degrees of non-detecting target respective regions of the virtually divided regions other than the detecting target region based on the relative values of the non-detecting-target respective regions, the relative value of the detecting target region, and the deterioration degree of the detecting target region, wherein the latent image writing device writes a latent image onto the image bearer with its orientation being changed when the equalizing orientation determining device has determined that the deterioration degrees of the virtually divided respective regions can be substantially equalized by changing the orientation of the next image, and wherein the counter counts the numbers of pixels of the orientation changed next image output to the virtually divided respective regions when the orientation of the latent image is changed.

3. A method of forming an image comprising the steps of:

bearing a latent image on a surface of a rotatable latent image bearer;

electrically charging the surface of the latent image bearer;

writing the latent image on the electrically charge surface of the latent image bearer after charging thereof;

developing the latent image borne on the surface of the latent image bearer;

detecting a potential of the surface of the latent image bearer;

determining a deterioration degree of the latent image bearer based on a detected potential;

counting and aggregating the number of pixels output after the latent image bearer is newly used to each of virtually divided regions, the virtually divided regions of the latent image bearer defined by virtually dividing the surface of the latent image bearer into multiple regions in a direction perpendicular to a rotating direction of the latent image bearer;

determining a time value in accordance with a time at which a pixel is output to the virtually divided region, in which the pixel is determined to be outputted recently or outputted relative to a predetermined number of sheets that have been printed;

detecting a potential of a detecting target region;

calculating a relative value based on the aggregated number of pixels and the time value per virtually divided region;

determining a deterioration degree of the detecting target region based on the potential detected by the surface potential detector;

determining deterioration degrees of non-detecting-target respective regions other than the detecting target region based on the relative values of the non-detecting-target respective regions, the relative value of the detecting target region, and the deterioration degree of the detecting target region; and transmitting a message that expiration of the latent image bearer is reached when the deterioration degree of any one of the virtually divided regions reaches or exceeds a prescribed threshold.

4. A method of forming an image comprising the steps of:

bearing a latent image on a surface of a rotatable latent image bearer;

electrically charging the surface of the latent image bearer;

writing the latent image on the electrically charge surface of the latent image bearer after charging thereof;

developing the latent image borne on the surface of the latent image bearer;

detecting a potential of the surface of the latent image bearer;

determining a deterioration degree of the latent image bearer based on a detected potential;

counting and aggregating the number of pixels output after the latent image bearer is newly used to each of virtually divided regions, the virtually divided regions of the latent image bearer defined by virtually dividing the surface of the latent image bearer into multiple regions in a direction perpendicular to a rotating direction of the latent image bearer;

determining a time value in accordance with a time at which a pixel is output to the virtually divided region, in which the pixel is determined to be outputted recently or outputted relative to a predetermined number of sheets that have been printed;

detecting a potential of a detecting target region;

calculating a relative value based on the aggregated number of pixels and the time value per virtually divided region;

determining a deterioration degree of the detecting target region based on the potential detected by the surface potential detector; and determining deterioration degrees of non-detecting-target respective regions other than the detecting target region based on the relative values of the non-detecting-target respective regions, the relative value of the detecting target region, and the deterioration degree of the detecting target region;

determining whether or not the deterioration degrees of the virtually divided respective regions can be substantially equalized by changing an orientation of the next image after counting the numbers of pixels of the next image output to the virtually divided respective regions when the next image is formed on the surface of the latent image bearer in a normal orientation based on image information;

writing a latent image onto the image bearer with its orientation being changed when it is determined that the deterioration degrees of the virtually divided respective regions can be substantially equalized by changing the orientation of the next mage;

counting the numbers of pixels of the orientation changed image output to the virtually divided respective regions when the orientation of the latent image is changed; and transmitting a message that expiration of the latent image bearer is reached when the deterioration degree of any one of the virtually divided regions reaches or exceeds a prescribed threshold.

* * * * *